US009571936B2

(12) United States Patent
Porter et al.

(10) Patent No.: US 9,571,936 B2
(45) Date of Patent: Feb. 14, 2017

(54) AUDIO SPEAKER HAVING A HIGH-SATURATION MAGNETIC INSERT

(71) Applicant: Apple Inc., Cupertino, CA (US)

(72) Inventors: Scott P. Porter, San Jose, CA (US); Christopher Wilk, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/702,623

(22) Filed: May 1, 2015

(65) Prior Publication Data

US 2016/0323674 A1 Nov. 3, 2016

(51) Int. Cl.

| | |
|---|---|
| ***H04R 9/02*** | (2006.01) |
| ***H04R 9/04*** | (2006.01) |
| ***H04R 9/06*** | (2006.01) |
| ***H04R 31/00*** | (2006.01) |

(52) U.S. Cl.

CPC ..... *H04R 9/025* (2013.01); *H04R 9/045* (2013.01); *H04R 9/06* (2013.01); *H04R 31/006* (2013.01); *H04R 2209/024* (2013.01)

(58) Field of Classification Search

CPC ..... H04R 9/00; H04R 9/025; H04R 9/027
USPC ..... 381/396, 412–414, 421–422
See application file for complete search history.

(56) References Cited

U.S. PATENT DOCUMENTS

| | | | | |
|---|---|---|---|---|
| 5,835,612 | A * | 11/1998 | Fujihira | H04R 9/025 381/412 |
| 6,621,911 | B2 * | 9/2003 | Kobayashi | H04R 9/06 381/396 |
| 7,362,878 | B2 | 4/2008 | Miller et al. | |
| 7,912,240 | B2 | 3/2011 | Madaffari et al. | |

* cited by examiner

*Primary Examiner* — Suhan Ni
(74) *Attorney, Agent, or Firm* — Blakely, Sokoloff, Taylor & Zafman LLP

(57) ABSTRACT

An audio speaker having a magnetic system that includes a magnetic insert in a recess of a bottom plate, is disclosed. More particularly, embodiments of the magnetic system include a magnetic insert having a higher magnetic saturation level than the bottom plate. Other embodiments are also described and claimed.

17 Claims, 17 Drawing Sheets

DETAIL A

DETAIL B

B - B

C - C

C - C

DETAIL C

DETAIL C

DETAIL C

AUDIO SPEAKER HAVING A HIGH-SATURATION MAGNETIC INSERT

BACKGROUND

Field

Embodiments related to audio speakers are disclosed. More particularly, an embodiment related to an audio speaker, which includes a magnetic system having a magnetic insert in a recess of a bottom plate, is disclosed. The magnetic insert may have a higher magnetic saturation level than the bottom plate.

Background Information

An audio speaker, such as a loudspeaker, converts an electrical audio input signal into an emitted sound. Audio speakers typically include a moving assembly that oscillates relative to a stationary assembly. For example, the moving assembly may include a diaphragm connected to a driving element, such as voicecoil. The stationary assembly may include a magnetic system having magnetic components, e.g., one or more permanent magnets sandwiched between a top plate and a bottom plate, to form a magnetic circuit through which a magnetic flux travels. More particularly, when an electrical audio input signal is input to the voicecoil, the electrical current reacts with a magnetic field of the magnetic system, and generates a mechanical force that moves the moving assembly from a neutral position in an axial direction relative to the stationary assembly.

SUMMARY

Electronic devices having audio speakers are becoming more compact, and as the form factors of these devices shrink, the space available for the audio speaker also reduces. Accordingly, the size of the magnetic system components must be reduced to fit within the audio speaker enclosure. However, as the magnetic components are miniaturized, e.g., as a top plate or a bottom plate of the magnetic circuit becomes thinner, the thinner magnetic components are unable to contain the applied magnetic field within the component cross-section. That is, when the magnetic field in the thinner component reaches a saturation limit, e.g., when the entire cross-section is saturated by the magnetic field, magnetic flux tends to leak out of the magnetic circuit into a surrounding environment. In some cases, this stray flux can leak into nearby low coercivity items, e.g., hotel keys, gift cards, and parking tickets. The stray flux may then cause the low coercivity items to demagnetize and lose stored data. Thus, a magnetic system having components with higher saturation limits may allow the magnetic field in the magnetic system to be increased and the stray magnetic flux to be reduced within a compact form factor. The increased magnetic field may generate a larger mechanical force on the voicecoil to improve acoustic performance of the audio speaker, and the reduced stray magnetic flux may prevent demagnetization of nearby magnetic strip cards.

In an embodiment, an audio speaker includes a magnetic circuit through one or more magnets and a magnetic insert in a bottom plate. The bottom plate may have a support face and a recess. A center magnet and a lateral magnet may be located on the support face over the recess and be radially separated from each other by a magnet gap aligned with a voicecoil to drive a diaphragm. The recess may include a recessed face below the support face, and the recess may be in the support face and/or a rear face of the bottom plate, opposite from the support face, such that the recessed face faces a same direction as the support face, i.e., a forward direction, and/or an opposite direction as the support face, i.e., a rearward direction. Thus, a magnetic insert may be located in the recess on the recessed face below the lateral magnet and the center magnet. Both the bottom plate and the magnetic insert may include a magnetic material, and the magnetic materials may differ. For example, the bottom plate may be formed from a magnetic steel material and the magnetic insert may be formed from a high-saturation magnetic material, e.g., an iron-cobalt (FeCo) alloy such as Hiperco®, Vacoflux®, or similar high permeability FeCo alloys. Thus, the magnetic saturation level of the magnetic insert may be greater, e.g., at least 10% greater, than the magnetic saturation level of the bottom plate. Accordingly, the magnetic insert may form a preferential magnetic flux path from the lateral magnet to the center magnet to contain the magnetic field within the audio speaker.

The magnetic system components may have a variety of relative positions and configurations. For example, the magnetic insert may include an upper face overlapping respective lower faces of the lateral magnet and the center magnet. The upper face may include a radial width between an outer edge under the lateral magnet and an inner edge, and the radial width may be wider than the magnet gap between the lateral magnet and the center magnet. Thus, the magnetic flux path may be directed from the lateral magnet into a first overlapping portion of the upper face and from a second overlapping portion of the upper face to the center magnet. In an embodiment, the overlapping portions of the magnetic insert may be in contact with the lateral magnet and/or the center magnet such that the magnetic flux path transitions directly from the magnets into the magnetic insert.

The magnetic insert may have a variety of shapes and dimensions. For example, the magnetic insert may have a thin, annular structure. Accordingly, the magnetic insert may have a thickness less than 1.5 mm. Furthermore, in an embodiment, the upper face of the magnetic insert may be ring-shaped such that the inner edge defines a central opening under the center magnet.

The magnetic insert may have a variety of structural configurations. For example, the magnetic insert may have a laminate structure that includes two or more layers. A first layer of the laminate structure may be located on the recessed face of the recess, and a second layer of the laminate structure may be located on the first layer. The layers may have differing widths. For example, the first layer may have a different width than the second layer, resulting in a cross-sectional profile with a stepped or tapered sidewall.

In an embodiment, an audio speaker includes a bottom plate with several recesses that provide radial gaps between a central region of the support face and a lateral region of the support face. The center magnet may be disposed on the central region and several lateral magnets may be disposed on the lateral region around the center magnet. Furthermore, several magnetic inserts may be located in respective recesses of the bottom plate to form a magnetic flux path from a respective lateral magnet to the center magnet through respective radial gaps of the recesses. The lateral magnets may be symmetrically disposed around the center magnet to generate a symmetric magnetic field. Furthermore, as described above, the recesses may include respective recessed faces that face a same or opposite direction as the support face.

In an embodiment, a method of fabricating an audio speaker includes forming a plate from a magnetic material, e.g., magnetic steel. The plate may include a support face and a recess. For example, forming the plate may include pressing the recess into the plate. The method further includes cutting a magnetic insert from a sheet of magnetic material, e.g., a high permeability FeCo alloy. For example, cutting the magnetic insert may include die-cutting the magnetic insert from the sheet of magnetic material. In an embodiment, the sheet of magnetic material is from a rolled sheet of magnetic material. The magnetic saturation levels of the plate and the magnetic insert may differ. For example, the magnetic saturation level of the magnetic insert may be greater than the magnetic saturation level of the plate. The method may further include inserting the magnetic insert into the recess and attaching one or more magnets to the support face. For example, the magnetic insert may be placed on a recessed face in the recess and a magnet may be attached adjacent to the support face. Accordingly, the magnetic insert in the recess may be disposed near the magnet to form a magnetic flux path from the magnet.

In an embodiment, an audio speaker includes a magnetic insert in a plate. The plate may have a support face and a recess. A magnet may be located adjacent to the support face and aligned with a voicecoil. The voicecoil may drive a diaphragm such that the voicecoil moves the diaphragm when a current in the voicecoil creates a first magnetic field that interacts with a second magnetic field created by the magnet. The recess may include a recessed face below the support face. Thus, a magnetic insert may be located in the recess on the recessed face, and be disposed near the magnet to form a magnetic flux path from the magnet. For example, the magnetic insert may be in contact with the magnet. Both the plate and the magnetic insert may include a magnetic material, and the magnetic materials may differ. For example, the plate may be formed from a magnetic steel material and the magnetic insert may be formed from a high-saturation magnetic material, e.g., an FeCo alloy such as Hiperco®, Vacoflux®, or similar high permeability FeCo alloys. Thus, the magnetic saturation level of the magnetic insert may be greater, e.g., at least 10% greater, than the magnetic saturation level of the plate.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
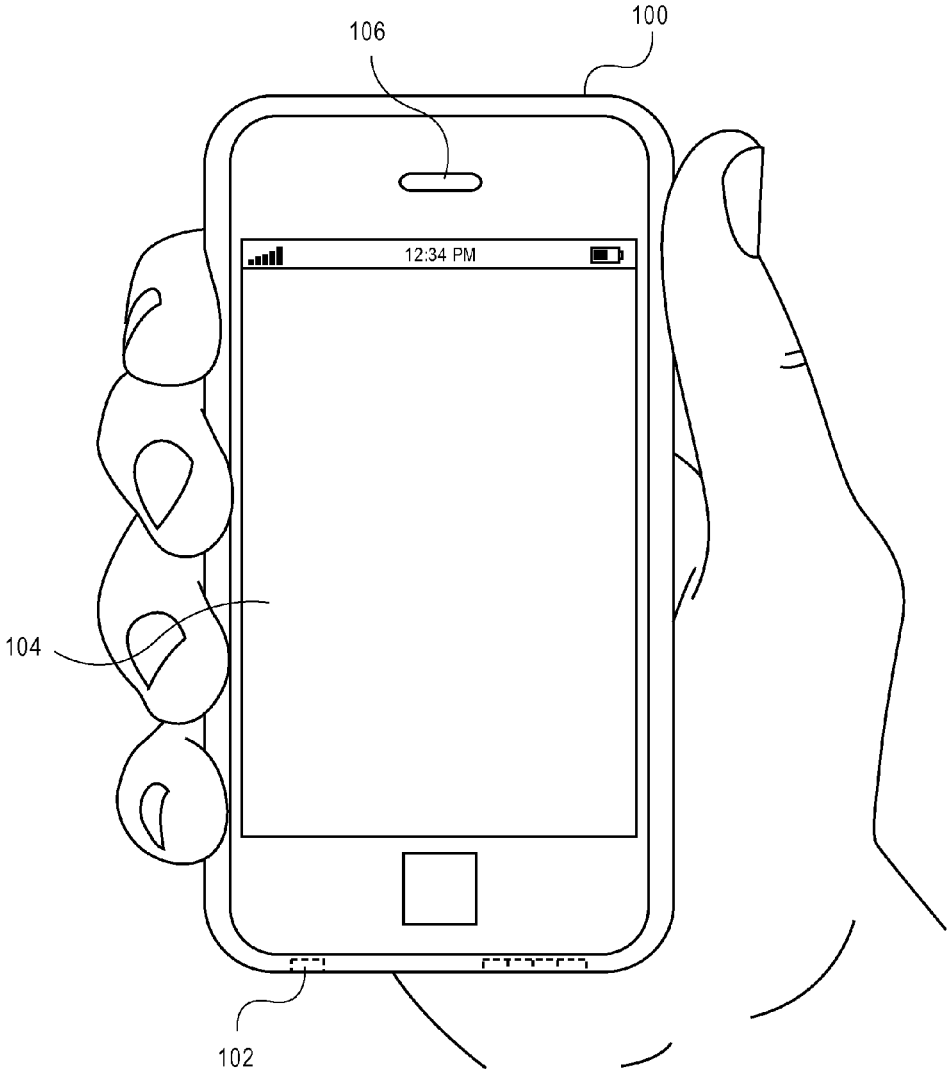
FIG. 1 is a pictorial view of an electronic device in accordance with an embodiment.

Embodiments describe audio speakers having magnetic systems that include a magnetic insert in a recess of a bottom plate, particularly for use in audio speaker applications. The magnetic insert may have a higher magnetic saturation level than the bottom plate. Some embodiments are described with specific regard to integration within mobile electronics devices having audio speakers, however, the embodiments are not so limited and certain embodiments may also be applicable to other uses. For example, an audio speaker as described below may be incorporated into other devices and apparatuses, including desktop computers, laptop computers, or motor vehicles, to name only a few possible applications.

In various embodiments, description is made with reference to the figures. Certain embodiments, however, may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description, such as "forward" and "rearward" may denote a relative position or direction. For example, a direction may be described as being "forward" from a diaphragm to denote a direction that sound propagates from the diaphragm toward a speaker port, while a "rearward direction" may be opposite to the forward direction. Nonetheless, such terms are not intended to limit the use of an audio speaker to a specific configuration described in the various embodiments below. For example, an audio speaker may be directed in any direction with respect to an external environment, including such that sound is directed upward, downward, sideways, etc., relative to a listener.

In an aspect, an audio speaker includes a magnetic system that provides a magnetic circuit that supports an increased magnetic field. More particularly, the magnetic system includes a high-saturation magnetic insert in a bottom plate, and the magnetic insert has a higher magnetic saturation level than the bottom plate. Furthermore, the magnetic insert may be shaped to cover saturation hot spots, e.g., at a location where a magnet corner would contact the bottom plate in the absence of the insert, to specifically increase the magnetic saturation level of those locations. Accordingly, the magnetic system supports a higher magnetic field before saturating, which may result in a higher drive factor and an improved acoustic performance for the audio speaker.

In an aspect, an audio speaker having a high-saturation magnetic insert covering saturation hot spots constrains the magnetic field within a magnetic flux path between opposing magnets of the magnetic system. For example, the magnetic insert may provide a flux bridge between a lateral magnet on one side of a magnetic gap and a center magnet on another side of the magnetic gap. Furthermore, the higher magnetic saturation level of the magnetic insert may reduce the likelihood of the saturation hot spots or the cross-section of the magnetic system becoming magnetically saturated. Thus, the magnetic flux may be constrained within the magnetic system between the offset magnets rather than leaking into the surrounding environment. Accordingly, the likelihood that stray flux will demagnetize low coercivity items, e.g., hotel keys, gift cards, parking tickets, etc., near the audio speaker may be reduced.

In an aspect, a method of manufacturing an audio speaker having a high-saturation magnetic insert to increase acoustic performance and decrease stray flux within a compact form factor is provided. Rather than forming an entire bottom plate of the audio speaker from high magnetic saturation material, which may be difficult to shape and costly to make, a high-saturation magnetic insert may be cut, e.g., die-cut, from a sheet of high saturation magnetic material, and inserted into the most critical regions of a stamped or forged bottom plate. Stamping and forging are known processes that may be used to mass produce bottom plates and die-cutting may be used for mass producing high-saturation magnetic inserts for a magnetic system of an audio speaker in a cost-efficient manner. The recess in the bottom plate may be formed either by forging, stamping, or by chemically etching a stamped plate. Furthermore, by inserting the magnetic insert into recesses in the bottom plate, the z-height of the bottom plate and the audio speaker may be limited.

Referring to FIG. 1, a pictorial view of an electronic device is shown in accordance with an embodiment. Electronic device 100 may be a smartphone device. Alternatively, it could be any other portable or stationary device or apparatus, such as a laptop computer or a tablet computer. Electronic device 100 may include various capabilities to allow the user to access features involving, for example, calls, voicemail, music, e-mail, internet browsing, scheduling, and photos. Electronic device 100 may also include hardware to facilitate such capabilities. For example, an integrated microphone 102 may pick up the voice of a user during a call, and an audio speaker 106, e.g., a micro speaker, may deliver a far-end voice to the near-end user during the call. Audio speaker 106 may also emit sounds associated with music files played by a music player application running on electronic device 100. A display 104 may present the user with a graphical user interface to allow the user to interact with electronic device 100 and/or applications running on electronic device 100. Other conventional features are not shown but may of course be included in electronic device 100.

Figure 2:
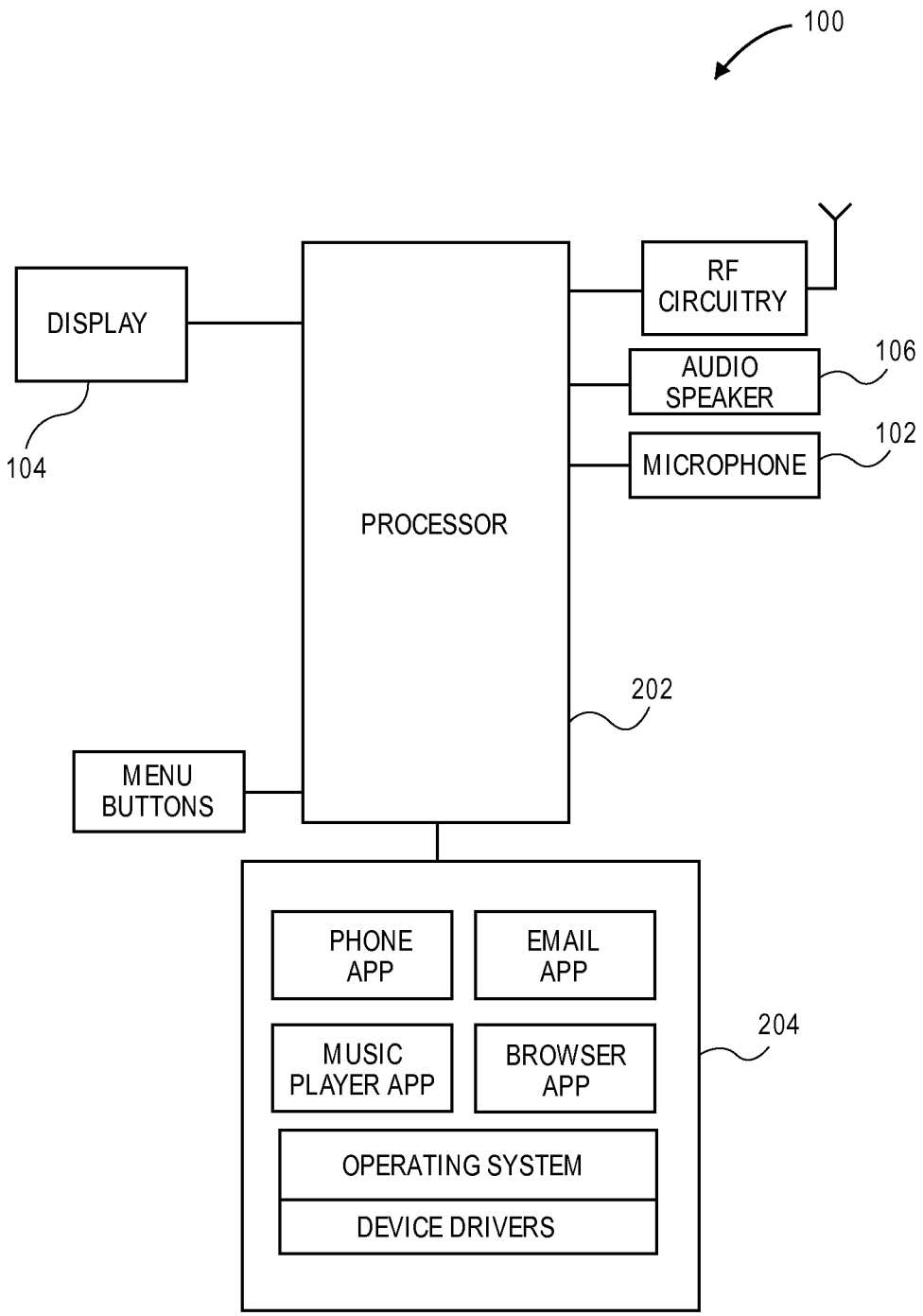
FIG. 2 is a schematic view of an electronic device having an audio speaker in accordance with an embodiment.

Referring to FIG. 2, a schematic view of an electronic device having an audio speaker is shown in accordance with an embodiment. As described above, electronic device 100 may be one of several types of portable or stationary devices or apparatuses with circuitry suited to specific functionality. Thus, the diagrammed circuitry is provided by way of example and not limitation. Electronic device 100 may include one or more processors 202 that execute instructions to carry out the different functions and capabilities described above. Instructions executed by the one or more of processors 202 of electronic device 100 may be retrieved from a local memory 204, and may be in the form of an operating system program having device drivers, as well as one or more application programs that run on top of the operating system, to perform the different functions introduced above, e.g., phone or telephony and/or music play back. For example, processor(s) 202 may directly or indirectly implement control loops and provide drive signals to a voicecoil of audio speaker 106 to drive a diaphragm motion and generate sound.

Figure 3:
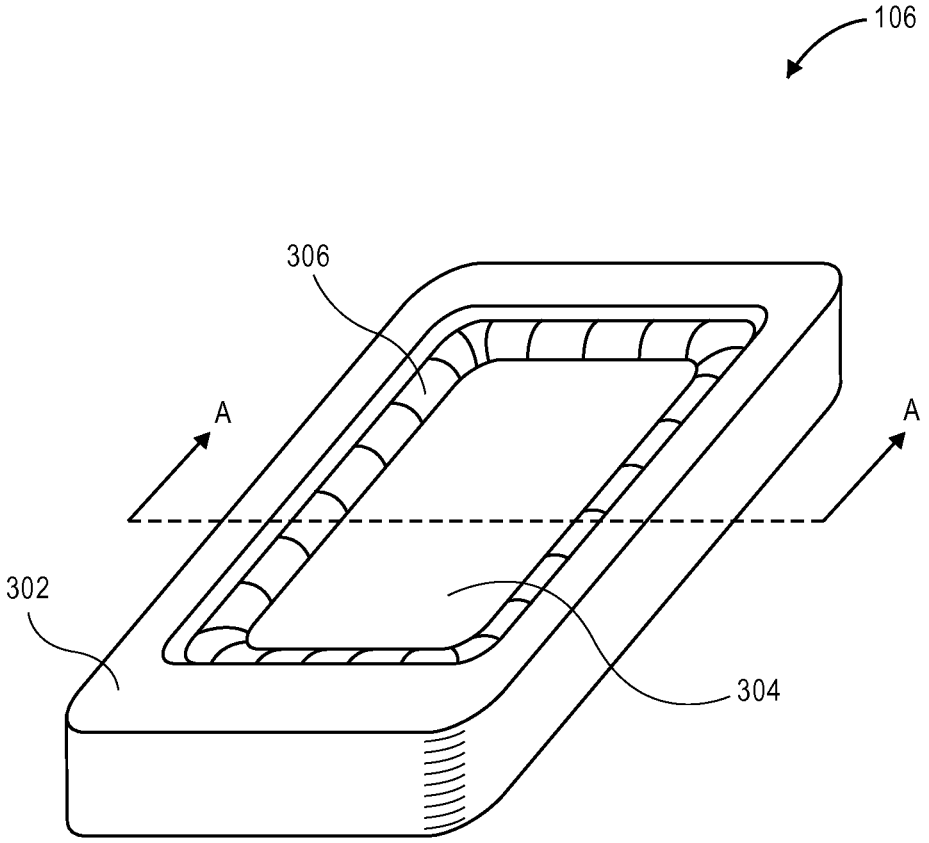
FIG. 3 is a perspective view of an audio speaker in accordance with an embodiment.

Referring to FIG. 3, a perspective view of an audio speaker is shown in accordance with an embodiment. An audio speaker 106 may be any type of loudspeaker. For example, audio speaker 106 may be a micro speaker. A micro speaker, also known as a microdriver, is a miniaturized implementation of a loudspeaker having a broad frequency range. Thus, audio speaker 106 may have a small form factor defined by an exterior surface of a housing 302, a diaphragm 304, and a surround 306 supporting the diaphragm relative to housing 302. These components may have various geometries that combine to create an outer envelope of audio speaker 106, and although the outer envelope is represented in FIG. 3 as having essentially a rectangular cuboid shape, the outer envelope may be other shapes, e.g., cylindrical, to facilitate placement of audio speaker 106 within a corresponding internal space of electronic device 100.

Figure 4:
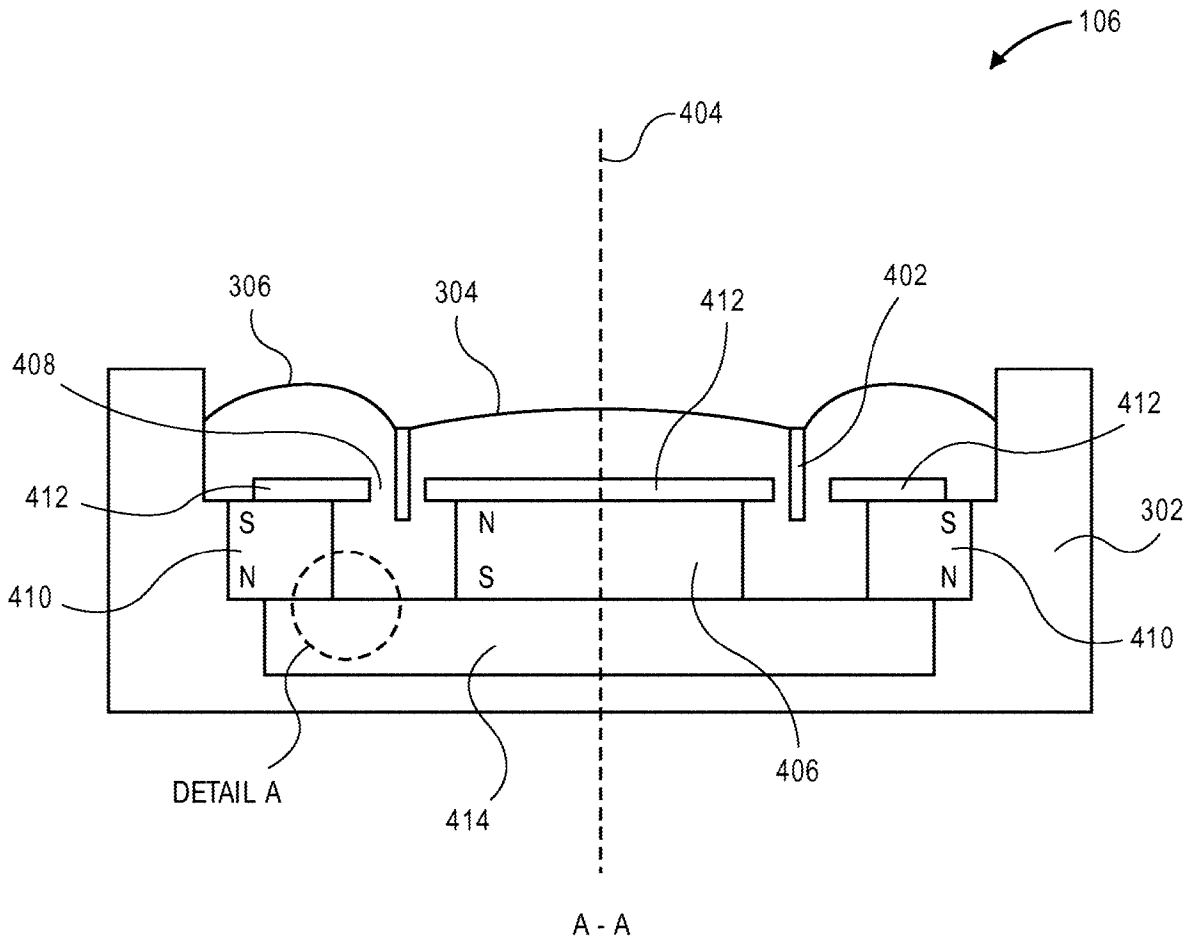
FIG. 4 is a cross-sectional view, taken about line A-A of FIG. 3, of an audio speaker in accordance with an embodiment.

Referring to FIG. 4, a cross-sectional view, taken about line A-A of FIG. 3, of an audio speaker 106 is shown in accordance with an embodiment. The outer envelope of audio speaker 106 may surround a moving assembly and a stationary assembly. In an embodiment, the moving assembly includes the portion of audio speaker 106 that moves in conjunction with diaphragm 304 during sound generation. For example, the moving assembly may include surround 306, diaphragm 304, and a voicecoil 402. Surround 306 may flex and deflect when diaphragm 304 oscillates along a central axis 404 during music or voice reproduction by electronic device 100. Similarly, voicecoil 402 may be connected to diaphragm 304 to move and impart the driving force that causes diaphragm 304 to oscillate along central axis 404.

In an embodiment, the stationary assembly of audio speaker 106 includes a magnetic system, which generates a magnetic field through which voicecoil 402 moves during sound creation. The magnetic system may include one or more magnets in a magnetic circuit. For example, each magnet may generate a magnetic field between opposing poles. In an embodiment, a center magnet 406 is laterally offset from one or more lateral magnets 410. Center magnet 406 and lateral magnet(s) 410 may be permanent magnets, having respective opposite poles (denoted as "N" and "S" for "north" and "south" in FIG. 4). Furthermore, the magnetic circuit may include a top plate 412 and a bottom plate 414 near respective poles of the magnets. Top plate 412 and bottom plate 414 may be formed from magnetic materials, e.g., magnetic steel, such that the magnetic field is directed through top plate 412 and bottom plate 414 between poles of the offset magnets. For example, magnetic flux may be directed along a path from an upper pole, e.g., a "north" pole, of center magnet 406, into an inner region of top plate 412 intersected by central axis 404 and across a magnetic gap 408 to an outer region of top plate 412 radially outward of the inner region and near an upper pole, e.g., a "south" pole, of lateral magnet 410. The magnetic flux path may be directed to an opposite pole of lateral magnet 410, e.g., a "north" pole, and into bottom plate 414 toward the opposite pole, e.g., a "south" pole, of center magnet 406. The magnetic field may be distributed through center magnet 406, top plate 412, lateral magnet 410, and bottom plate 414 such that magnetic flux is concentrated in a radial direction across magnetic gap 408 within which voicecoil 402 is located. As such, when an electrical audio input signal is input to voicecoil 402, the electrical current travels orthogonal to the magnetic flux (into or out of the page) in magnetic gap 408 and reacts with the magnetic field to generate the driving force that moves the moving assembly from a neutral position in an axial direction along central axis 404.

Figure 5:
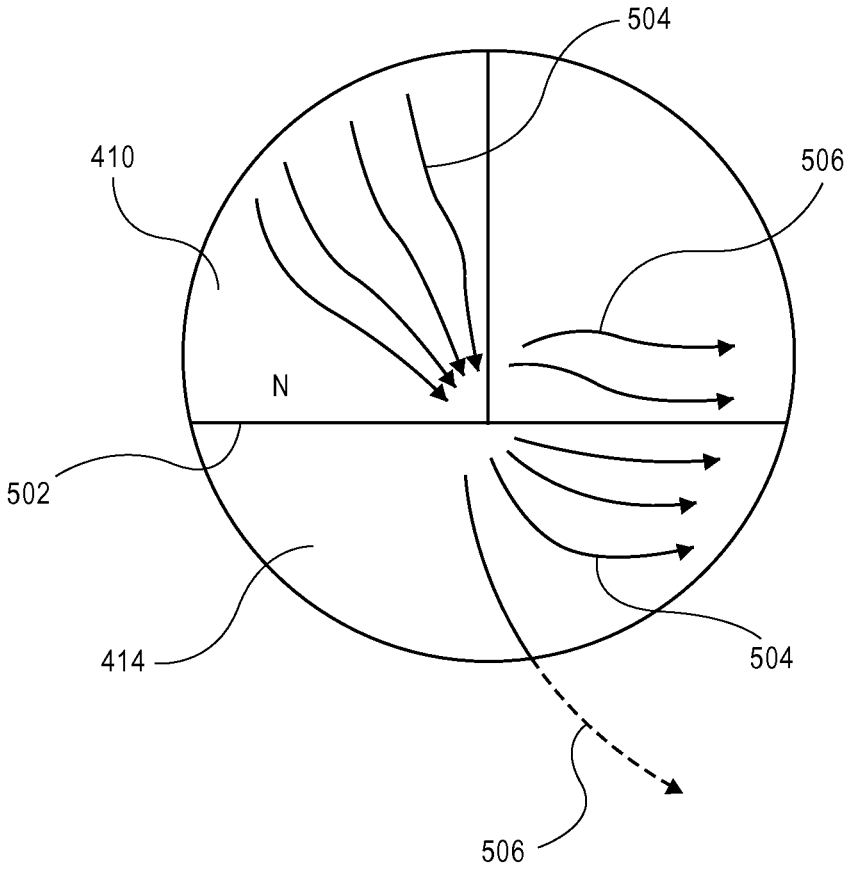
FIG. 5 is a detail view, taken from Detail A of FIG. 4, of a magnetic flux path through an audio speaker in accordance with an embodiment.

Referring to FIG. 5, a detail view, taken from Detail A of FIG. 4, of a magnetic flux path through an audio speaker is shown in accordance with an embodiment. The magnetic system of audio speaker 106 may include transition points at which magnetic flux is directed from one magnetic component, e.g., lateral magnet 410, into another magnetic component, e.g., bottom plate 414. For example, a lower face 502 of lateral magnet 410 may be disposed on bottom plate 414, and thus, a radially inward edge or corner of lateral magnet 410 may be in contact with an upper surface of bottom plate 414. Furthermore, the magnetic field generated by the magnetic system may seek the shortest and/or least magnetically resistant path, and thus, the magnetic circuit may include a magnetic flux path 504 that converges at the corner, as shown. Each component of the magnetic circuit, however, includes a respective magnetic saturation level, which is the material state at which an increase in the magnetic field does not create a significant increase in the magnetic flux density. That is, as the magnetic field strength increases, the magnetic flux density in the bottom plate 414 at the junction of bottom plate 414 and the corner of lateral magnet 410 may reach a peak, and a continued increase in magnetic field causes magnetic flux path 504 to be directed along an alternate route between lateral magnet 410 and center magnet 406. The magnetic flux path 504 may grow across a thickness of bottom plate 414 because the permeability of bottom plate 414 may be higher than a material, e.g., air, above or below bottom plate 414. The bottom plate 414 may be a more attractive path for the magnetic flux due to this difference in magnetic permeability. Thus, magnetic flux path 504 may remain constrained within bottom plate 414 until the magnetic field is increased to a point at which a cross-section of bottom plate 414 is magnetically saturated. After the entire thickness of bottom plate 414 is saturated, however, magnetic flux may travel out of bottom plate 414 along a stray flux path 506 toward center magnet 406. Accordingly, some of the magnetic field that is directed along stray flux path 506 may escape housing 302. The escaped magnetic field may negatively affect nearby objects, e.g., by demagnetizing low coercivity objects.

Figure 6:
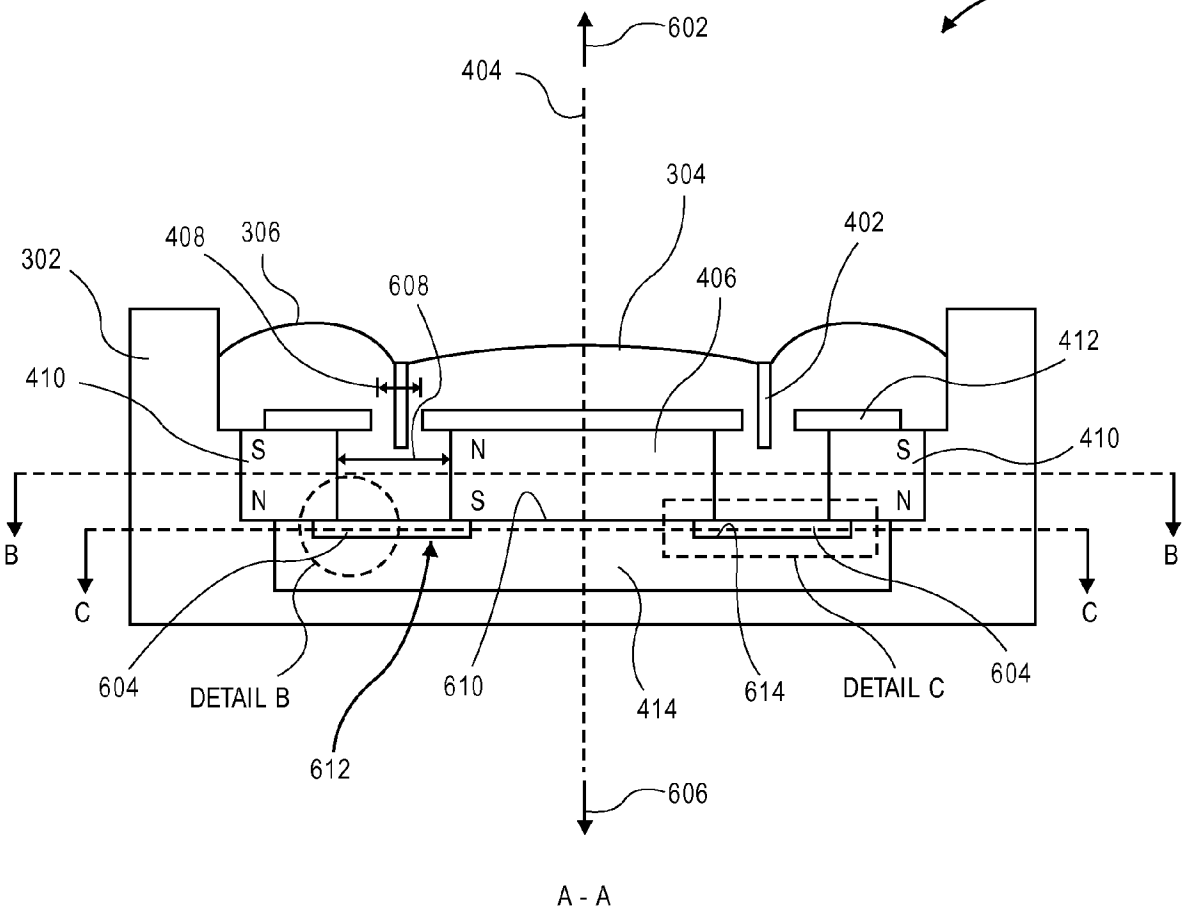
FIG. 6 is a cross-sectional view, taken about line A-A of FIG. 3, of an audio speaker in accordance with an embodiment.

Referring to FIG. 6, a cross-sectional view, taken about line A-A of FIG. 3, of an audio speaker is shown in accordance with an embodiment. An audio speaker 106 may include a magnetic system that allows the magnetic field to be increased without magnetically saturating components and causing stray flux to leak out of housing 302. In an embodiment, audio speaker 106 is a micro speaker and includes the moving assembly components described above, i.e., diaphragm 304 arranged along central axis 404, surround 306 supporting diaphragm 304 relative to housing 302, and voicecoil 402 to move diaphragm 304 in a forward direction 602 and a rearward direction 606 during sound generation. Voicecoil 402 may be disposed within magnetic gap 408 of a stationary assembly of audio speaker 106. More particularly, audio speaker 106 may include a magnetic system to generate a magnetic field, e.g., between center magnet 406 and lateral magnet(s) 410, and magnetic flux of the magnetic field may be concentrated in magnetic gap 408 between inner and outer regions of top plate 412. Voicecoil 402 may be located within the magnetic gap 408. Additionally, center magnet 406 and lateral magnet 410 may be spaced apart from each other by a magnet gap 608. For example, magnet gap 608 may be an air gap that radially separates lateral magnet 410 from center magnet 406. In an embodiment, magnet gap 608 may be behind magnetic gap 408, and thus, voicecoil 402 may be aligned with magnet gap 608 and/or be disposed within magnet gap 608, i.e., in rearward direction 606 from magnetic gap 608 at a location radially offset from central axis 404 between lateral magnet 410 and center magnet 406.

The magnetic field may circulate from a lower pole, e.g., a north pole, of lateral magnet 410 to a lower pole, e.g., a south pole, of center magnet 406 below the magnetic gap 408. For example, magnetic flux path 504 may be directed from lateral magnet 410 to center magnet 406 in a radial direction across magnetic gap 608. More particularly, the magnetic field may be directed through a magnetic insert 604 that provides a magnetic flux path 504 from lateral magnet 410 to center magnet 406 (or vice versa, depending upon the orientation of the magnet poles).

In an embodiment, magnetic insert 604 is located on a same side of bottom plate 414 as lateral magnet 410 and center magnet 406. For example, lateral magnet 410 and center magnet 406 may be disposed over a support face 610, which is located on an upper surface of bottom plate 414. More particularly, lateral magnet 410 may be located on, and may be supported by, an outer region of support face 610. Center magnet 406 may be located on, and may be supported by, an inner region of support face 610. Similarly, magnetic insert 604 may be located above bottom plate 414. For example, magnetic insert 604 may be located in a recess 612 formed in support face 610 of bottom plate 414. Recess 612 may for instance be stamped or otherwise formed in support face 610 in a shape and size to accommodate magnetic insert 604. Recess 612, therefore, may include a recessed face 614 below support face 610, i.e., recessed face 614 may be axially offset from support face 610 in rearward direction 606. Thus, recessed face 614 and support face 610 may both face a same direction, e.g., forward direction 602. In an embodiment, magnetic insert 604 may be disposed in recess 612 on recessed face 614, and thus, may include an upper surface facing in the same direction as support face 610 and recessed face 614, e.g., in forward direction 602.

In an embodiment, lateral magnet 410 and/or center magnet 406 may be located over recess 612. Center magnet 406 may be disposed on support face 610 and may at least partially overlap with recess 612 over a radial distance. That is, an axis parallel to central axis 404, but radially offset from central axis 404, may intersect both center magnet 406 and recess 612. Accordingly, in an embodiment in which magnetic insert 604 fills recess 612, the parallel axis may also intersect magnetic insert 604. Similarly, lateral magnet 410 may be disposed on support face 610 and may at least partially overlap with recess 612 over a radial distance. That is, another axis parallel to central axis 404, but radially offset from central axis 404, may intersect lateral magnet 410, recess 612, and magnetic insert 604 disposed in recess 612. Therefore, at least a portion of center magnet 406 and/or lateral magnet 410 may overlap magnetic insert 604.

Figure 7:
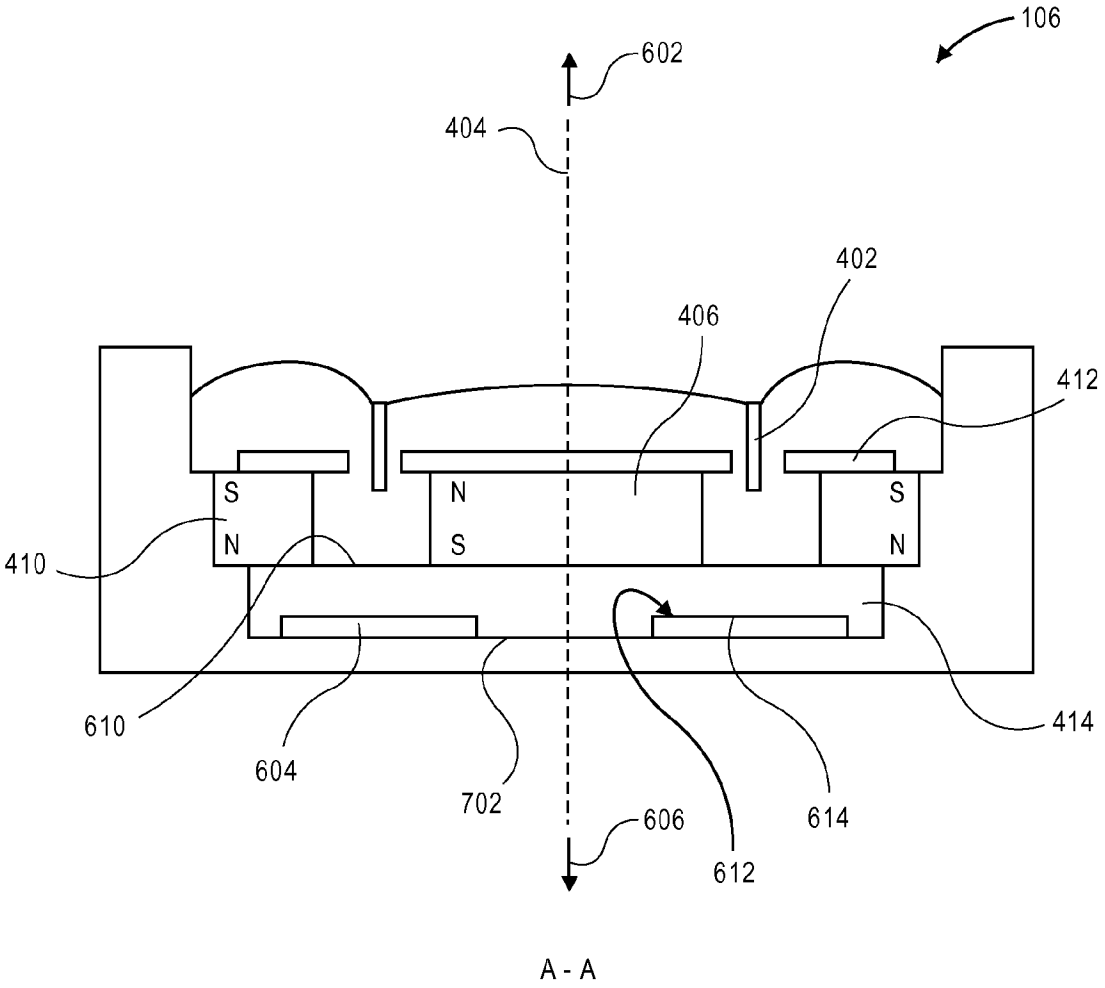
FIG. 7 is a cross-sectional view, taken about line A-A of FIG. 3, of an audio speaker in accordance with an embodiment.

Referring to FIG. 7, a cross-sectional view, taken about line A-A of FIG. 3, of an audio speaker is shown in accordance with an embodiment. In an embodiment, lateral magnet 410 and/or center magnet 406 may be located on an opposite side of bottom plate 414 from magnetic insert 604. For example, lateral magnet 410 and center magnet 406 may be disposed on support face 610 above bottom plate 414, and magnetic insert 604 may be located below bottom plate 414. For example, magnetic insert 604 may be located in recess 612 formed in a rear face 702 of bottom plate 414. Therefore, support face 610 may be facing forward direction 602 along central axis 404 and recessed face 614 of recess 612 may be facing another direction, e.g., recessed face 614 may be facing rearward direction 606 along central axis 404.

In an embodiment, lateral magnet 410 and/or center magnet 406 may be located over recess 612, but may be located on an opposite side of bottom plate 414 from magnetic insert 604. Center magnet 406 and lateral magnet 410 may be disposed on support face 610 and recess 612 may be formed in rear face 702, on an opposite side of bottom plate 414 than support face 610. Accordingly, an axis parallel to central axis 404, but radially offset from central axis 404, may intersect both center magnet 406 and recess 612 (or both lateral magnet 410 and recess 612). The parallel axis may also intersect magnetic insert 604 in recess 612. Thus, the magnets 406, 410 and the magnetic inserts 604 may be overlapping in the radial direction even though the components are not on the same side of bottom plate 414.

In an embodiment, audio speaker 106 may include bottom plate 414 having recesses 612 in both support face 610 and rear face 702. Furthermore, magnetic inserts 604 may be located in the recesses 612 on both sides of bottom plate 414. Thus, outward facing surfaces of magnetic inserts 604 may be directed in both forward direction 602 and rearward direction 606. In an embodiment, an axis parallel to central axis 404, but radially offset from central axis 404, may intersect one or both magnetic inserts 604 on opposite sides of bottom plate 414. For example, a magnetic insert 604 in a recess 612 formed in support face 610 may overlap one or both of lateral magnet 410 and center magnet 406, and thus, may be intersected by the axis. The magnetic insert 604 in a recess 612 in rear face 702, however, may be narrower than the upper magnetic insert 604, and thus, may not overlap or be directly under one or both magnets such that the axis intersects the magnets and the upper insert 604, but not necessarily the lower magnetic insert 604.

Figure 8:
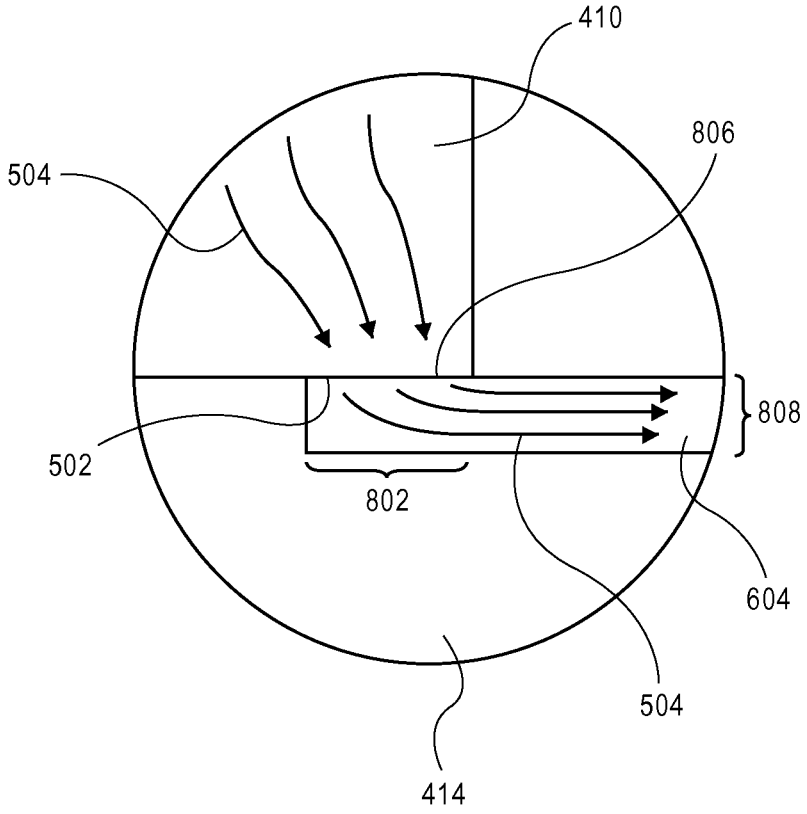
FIG. 8 is a detail view, taken from Detail B of FIG. 6, of a magnetic flux path through an audio speaker in accordance with an embodiment.

Referring to FIG. 8, a detail view, taken from Detail B of FIG. 6, of a magnetic flux path through an audio speaker is shown in accordance with an embodiment. Magnetic insert 604 located below lateral magnet 410 and/or center magnet 406 (on an upper and/or lower side of bottom plate 414) may form a magnetic flux path 504 from lateral magnet 410 to center magnet 406. In an embodiment, the magnetic flux path 504 may be preferentially directed between the magnet, e.g., lateral magnet 410, and magnetic insert 604 (directly or via an intervening portion of bottom plate 414). That is, although lateral magnet 410 may be located above and/or be placed in contact with both magnetic insert 604 and bottom plate 414, magnetic flux path 504 may preferentially travel from lateral magnet 410 into magnetic insert 604, rather than traveling from lateral magnet 410 to center magnet 406 entirely through bottom plate 414.

The preferential distribution of the magnetic field through magnetic insert 604 may be controlled by the material used to form magnetic insert 604 and bottom plate 414. In an embodiment, magnetic insert 604 may be formed from a material having a magnetic permeability higher than the magnetic permeability of the material used to form bottom plate 414. Additionally, the material used to form magnetic insert 604 may include a magnetic saturation level greater than a magnetic saturation level corresponding to the material used to form bottom plate 414. Accordingly, in an embodiment, magnetic flux is preferentially distributed in magnetic insert 604, rather than the adjacent bottom plate 414. The respective materials of magnetic insert 604 and bottom plate 414 may include any two magnetic materials having different magnetic properties. For example, bottom plate 414 may be formed from a magnetic steel, and magnetic insert 604 may be formed from a high-saturation magnetic material. A high-saturation magnetic material may be considered a material with a magnetic saturation level higher than magnetic steel. For example, a high-saturation magnetic material may include a magnetic saturation level that is at least 10% greater than the magnetic saturation level of magnetic steel. In an embodiment, magnetic insert 604 from high-saturation magnetic material includes a magnetic saturation level that is at least 20% greater than the magnetic saturation level of bottom plate 414. By way of example and not limitation, magnetic insert 604 may be formed from such high-saturation magnetic materials as iron-cobalt (FeCo) alloys, e.g., Hiperco®, Vacoflux®, or similar high permeability FeCo alloys. For example, high permeability FeCo alloys include Hiperco® 27, Hiperco® 50, Vacoflux® 17, and Vacoflux® 50, all of which are known materials. These materials and other similar high-saturation magnetic materials may have a magnetic saturation point between 2.0-3.0 Tesla, e.g., between 2.3-2.4 Tesla, as compared to magnetic steel materials that may typically include a magnetic saturation point between 1.0-2.2 Tesla, e.g., between 1.7-2.1 Tesla.

In an embodiment, magnetic insert 604 overlaps a portion of lateral magnet 410 and/or center magnet 406. For example, an overlapping portion 802 of the magnetic system may include a region where lower face 502 of lateral magnet 410 overlaps an upper face 806 of magnetic insert 604. The overlapping portion of upper face 806 of magnetic insert 604 below center magnet 406 may be in contact with the overlapping portion of the lower face of lateral magnet 410. Similarly, a lower face of center magnet 406 may overlap upper face 806 of magnetic insert 604 (not shown) to form an overlapping region where center magnet 406 overlaps magnetic insert 604. The overlapping portion 802 of the upper face 806 of magnetic insert 604 may be in contact with the overlapping portion 802 of the lower face of center magnet 406. As such, magnetic flux path 504 may travel from lower face 502 of lateral magnet 410 into upper face 806 of magnetic insert 604 where the faces overlap. Similarly, magnetic flux path 504 may travel from upper face 806 of magnetic insert 604 into a lower face 502 of center magnet 406 where the faces overlap (not shown). In an embodiment, a radial width of overlapping portion 802, e.g., a radial distance between an inward corner or edge of lateral magnet 410 and an outward corner or edge of magnetic insert 604 under lateral magnet 410, may be at least 0.5 mm. More particularly, magnetic insert 604 may have a thickness 808 in an axial direction, and the radial width of overlapping portion 802 may be at least half as wide as thickness 808 is thick. For example, in an embodiment, thickness 808 may be 1 mm, and thus, overlapping portions 802 of lateral magnet 410 and magnetic insert 604 may have a radial width 1008 of at least 0.5 mm, e.g., 1 mm or more. In an embodiment, thickness 808, and optionally the radial distance of overlapping portion 802, may be less than 3 mm. For example, in an embodiment in which magnetic insert 604 includes a single layer that is die-cut from a sheet of high-saturation magnetic material, thickness 808 may be less than 1.5 mm, or less than 0.050 inch.

Figure 9:
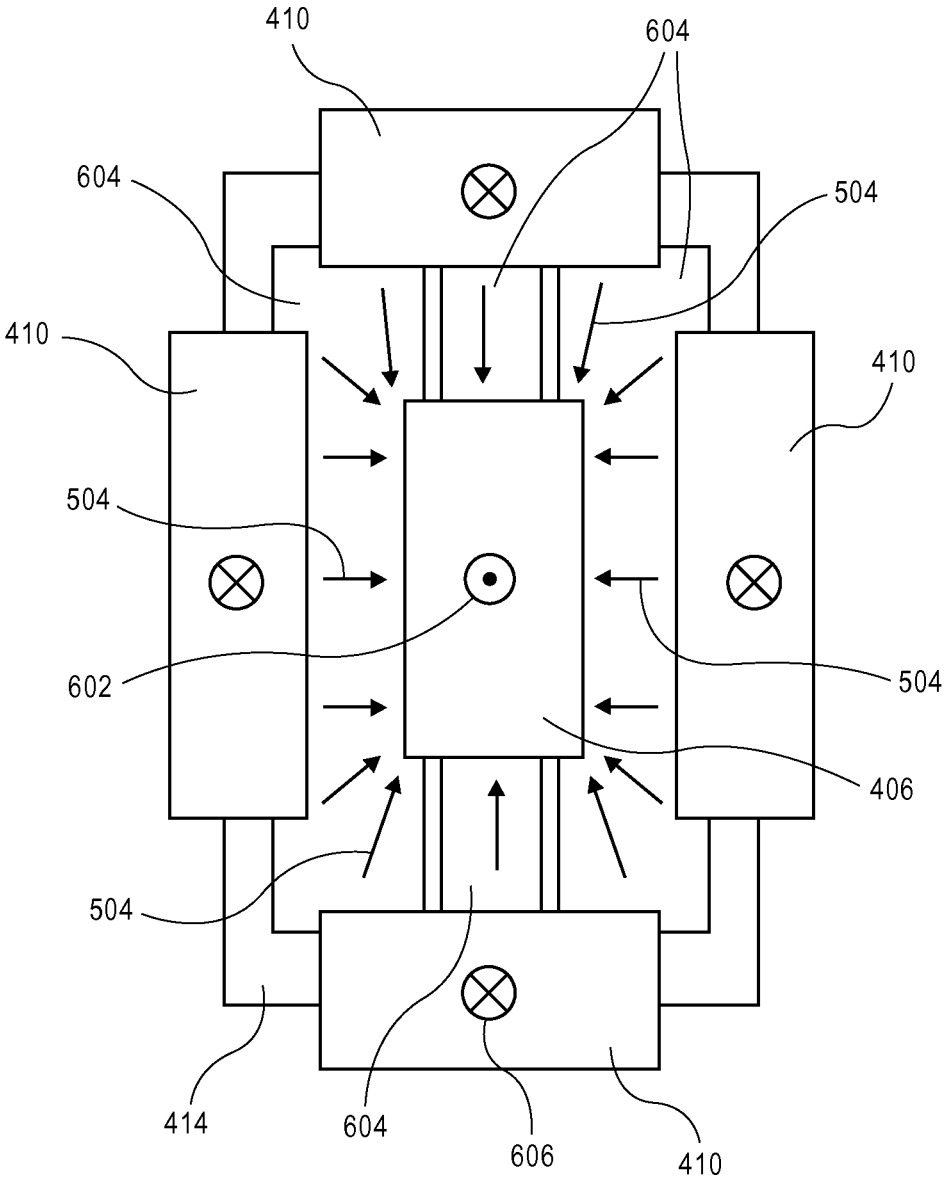
FIG. 9 is a cross-sectional view, taken about line B-B of FIG. 6, of a magnetic system of an audio speaker in accordance with an embodiment.

Referring to FIG. 9, a cross-sectional view, taken about line B-B of FIG. 6, of a magnetic system of an audio speaker is shown in accordance with an embodiment. The description above focuses on a cross-section of the magnetic circuit through center magnet 406, top plate 412, lateral magnet 410, and magnetic insert 604 (and/or bottom plate 414), along any given radial plane emanating from central axis 404. The magnetic field, however, may be symmetric about central axis 404. For example, the magnetic field may be ring-shaped, e.g., toroidal, when viewed in three-dimensional space, as when audio speaker 106 includes a magnetic system with several lateral magnets 410 disposed around center magnet 406. Center magnet 406 may be located between top plate 412 (not shown) and bottom plate 414. Thus, magnetic flux may be directed in forward direction 602 from center magnet 406 into top plate 412 and then conveyed through top plate 412 radially toward a nearest lateral magnet 410. The lateral magnets 410 may be disposed between top plate 412 and bottom plate 414. More particularly, bottom plate 414 may include a central region upon which center magnet 406 is located, and a lateral region upon which lateral magnets 410 are located. Thus, the magnetic field may be directed into lateral magnets 410 in rearward direction 606 from top plate 412, and then complete the magnetic circuit by radiating inward from lateral magnets 410 toward center magnet 406 along bottom plate 414.

Bottom plate 414 may include several recesses 612 that at least partly overlap with center magnet 406 and one or more lateral magnets 410. The recesses 612 may be depressions, grooves, counterbores, countersinks etc., located in support face 610 on which the magnets sit, and thus, a perimeter of each recess 612 may provide a radial gap between the center region of support face 610 and the lateral region of support face 610. As described above, bottom plate 414 may be formed from or otherwise include a magnetic material having a magnetic saturation level, e.g., magnetic steel with a magnetic saturation level between 1.7-2.1 Tesla. Accordingly, bottom plate 414 may provide a pathway for the magnetic flux to travel from lateral magnet 410 to center magnet 406 around the inner surfaces of recesses 612.

Several magnetic inserts 604 may be located in respective recesses 612 to provide preferential pathways for the magnetic flux to travel from lateral magnet 410 to center magnet 406. More particularly, magnetic inserts 604 may have a magnetic saturation level higher than the magnetic saturation level of bottom plate 414, e.g., between 2.3-2.4 Tesla. Thus, in an embodiment, the magnetic field preferentially distributes within magnetic insert 604 across the radial gap formed by the recesses 612 rather than travel around the inner surfaces of recesses 612 in bottom plate 414.

Still referring to FIG. 9, recesses 612 may be in support face 610 of bottom plate 414, and thus, recessed faces 614 of the respective recesses 612 (as well as an outward facing face of magnetic inserts 604 within recesses 612 in support face 610) may be directed in a same direction as support face 610, e.g., in forward direction 602. As described above, however, recesses 612 may be in rear face 702 of bottom plate 414. Thus, recessed faces 614 of the respective recesses 612 (as well as an outward facing face of magnetic inserts 604 within recesses 612 in rear face 702) may be directed in an opposite direction as support face 610. For example, support face 610 may be facing in forward direction 602 and recesses 612 face may be facing in rearward direction 606. Accordingly, magnetic inserts 604 may provide a radial pathway for magnetic flux to travel between one or more lateral magnets 410 and center magnet 406. The shape and configuration of magnetic inserts 604 to provide such radial pathways may be varied by one skilled in the art to satisfy design and manufacturing requirements. Several shapes and configurations are now described by way of example.

In an embodiment, one or more lateral magnets 410 are symmetrically disposed around center magnet 406. For example, two magnetic inserts 604 shaped as straight, rectangular bars may be arranged in two recesses 612 on opposite sides of a radial plane that is parallel to and intersects central axis 404. Referring again to FIG. 9, the straight magnetic inserts 604 may be parallel magnetic inserts 604, such as the leftmost magnetic insert 604 shown and the rightmost magnetic insert 604 shown, and the magnetic inserts 604 may have a length to provide overlapping portions that extend below an entire length of center magnet 406 and an entire length of a respective lateral magnet 410. That is, center magnet 406 and a respective lateral magnet 410 may have sidewalls that face each other across magnet gap 608, and the sidewalls may intersect with a lower face of a respective magnet along a sidewall edge, e.g., a corner. Thus, magnetic insert 604 may have a length that is at least as long as the sidewall edges of both magnets to provide an overlapping portion with both lower faces of the magnets along the entire length of the sidewall edges. As such, respective magnetic inserts 604 provide a magnetic flux path radially between lateral magnet 410 and center magnet 406 along the entire sidewall lengths of the magnets. In an embodiment, the magnetic inserts 604 may extend beyond the lateral lengths of the magnets to also include an overlapping portion with lateral magnets 410 illustrated in the 12 o'clock and 6 o'clock position relative to center magnet 406 in FIG. 9. That is, the rightmost and leftmost magnetic inserts 604 may be parallel with each other and have a length that is sufficient to overlap with center magnet 406 and at least one lateral magnet 410 on each side of center magnet 406, e.g., at the 12 o'clock, 3 o'clock, 6 o'clock, or 9 o'clock radial positions.

Figure 10:
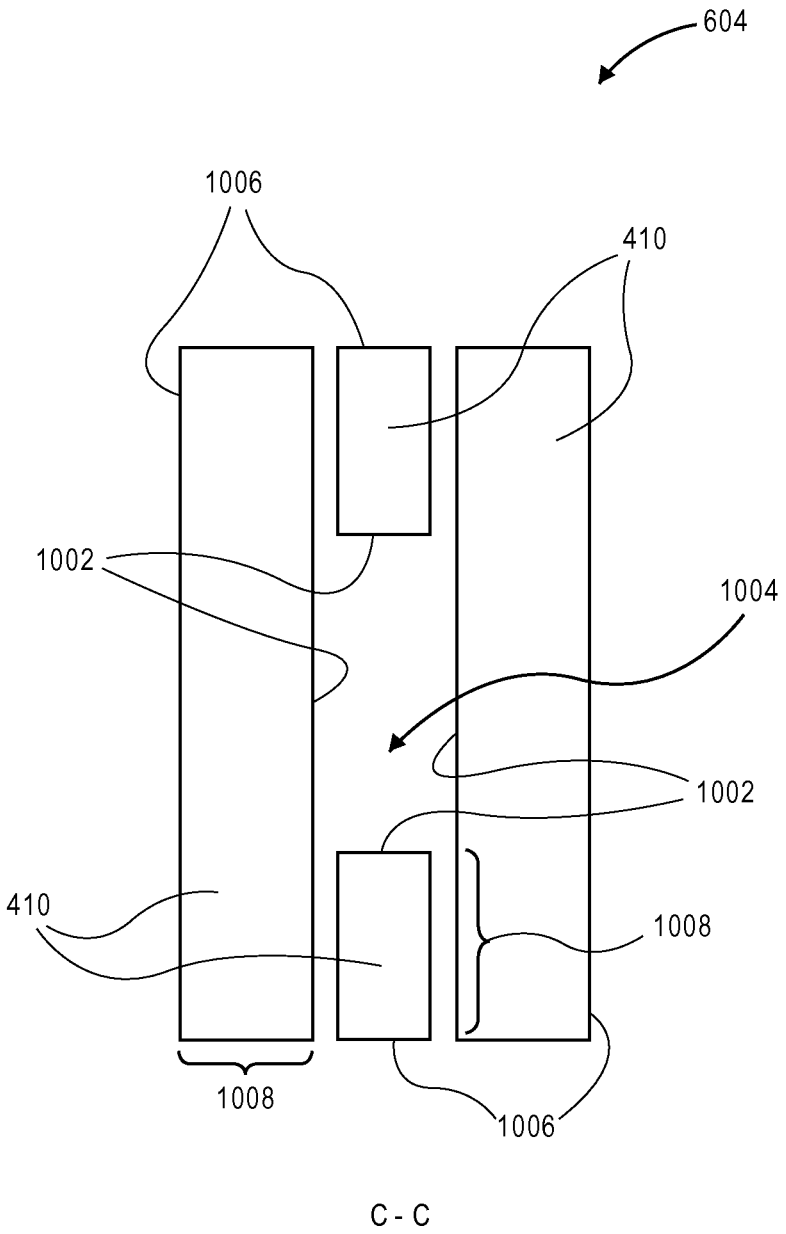
FIG. 10 is a cross-sectional view, taken about line C-C of FIG. 6, of a magnetic insert of an audio speaker in accordance with an embodiment.

Referring to FIG. 10, a cross-sectional view, taken about line C-C of FIG. 6, of a magnetic insert of an audio speaker is shown in accordance with an embodiment. Several lateral magnets 410, e.g., four lateral magnets 410, may be arranged to form an essentially ring-shaped structure around central axis 404. More particularly, each lateral magnet 410 may include an upper face with a respective inner edge 1002 or side. The inner edges 1002 may be arranged around central axis 404 to define a central opening 1004. Furthermore, the inner edges 1002, and thus the central opening 1004, may be under center magnet 406. That is, central opening 1004 may coincide with the central region of support face 610 upon which center magnet 406 is located. More particularly, central opening 1004 may be a space between inner edges 1002 of lateral magnets 410, and the space may be filled by the central region of bottom plate 414 beneath support face 610 such that support face 610 is facing forward direction 602 away from central opening 1004.

The upper face of each magnetic insert 604 may extend from the respective inner edge 1002 to a respective outer edge 1006 or wall separated from inner edge 1002 by a radial width 1008. Radial width 1008 may be wider than the radial distance between the center magnet 406 and the lateral magnet 410 over magnetic insert 604, i.e., radial width 1008 may be greater than a width of magnet gap 608, such that magnetic insert 604 includes overlapping portions under both lateral magnet 410 and center magnet 406. Alternatively, radial width 1008 may be less than a width of magnet gap 608 and magnetic insert 604 may include an overlapping portion under one of lateral magnet 410 or center magnet 406, but may not overlap with the other magnet.

Figure 11:
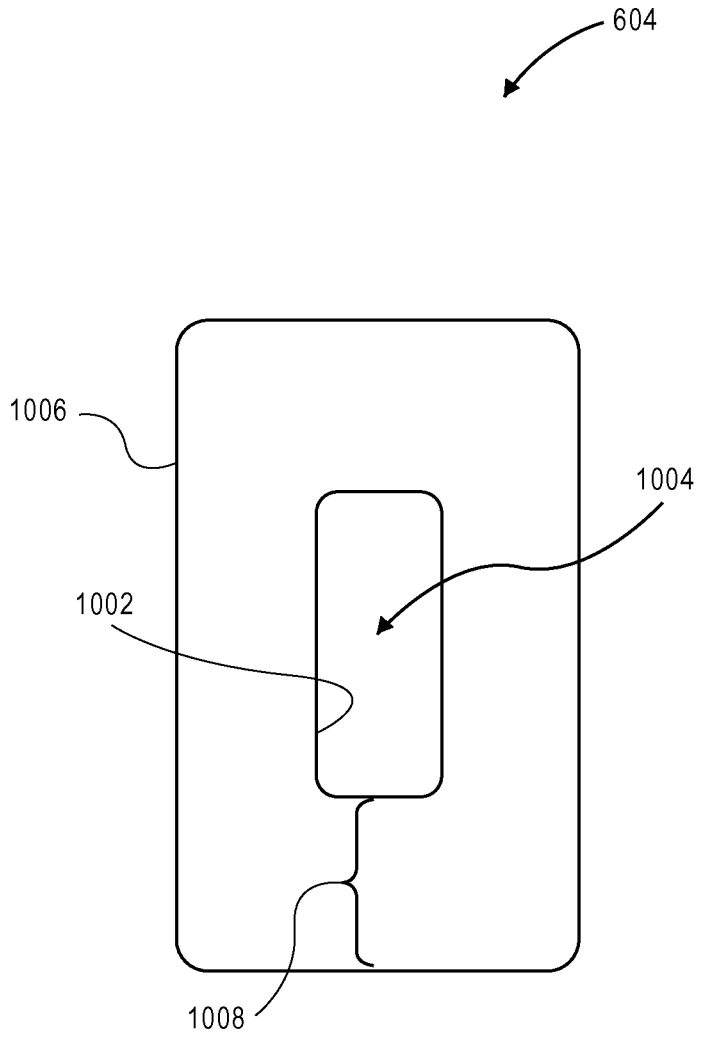
FIG. 11 is a cross-sectional view, taken about line C-C of FIG. 6, of a magnetic insert of an audio speaker in accordance with an embodiment.

Referring to FIG. 11, a cross-sectional view, taken about line C-C of FIG. 6, of a magnetic insert of an audio speaker is shown in accordance with an embodiment. The magnetic system may include a single magnetic insert 604 having inner edge 1002 or wall radially separated from outer edge 1006 or wall by radial width 1008. Inner edge 1002 and outer edge 1006 may both surround 306 central opening 1004. Accordingly, the body of magnetic insert 604 in the radial direction may be ring-shaped, e.g., annular. Thus, the central opening 1004 may coincide with a central region of bottom plate 414 having support face 610 upon which center magnet 406 is located. Furthermore, radial width 1008 may be wide enough to allow magnetic insert 604 to overlap with one or both of lateral magnet 410 and center magnet 406. Although the ring-shaped body of magnetic insert 604 is shown as having inner edge 1002 and outer edge 1006 with essentially rectangular shapes, the edges may have alternative shapes, e.g., circular shapes, and/or the shape of inner edge 1002 may differ from the shape of outer edge 1006. Nonetheless, magnetic insert 604 may have a radial width 1008 on all radial planes emanating from central axis 404 such that at least a portion of magnetic insert 604 forms a continuous path around center magnet 406 to provide a magnetic flux path 504 radially between lateral magnets 410 distributed near outer edge 1006 to center magnet 406 located near inner edge 1002.

Figure 12:
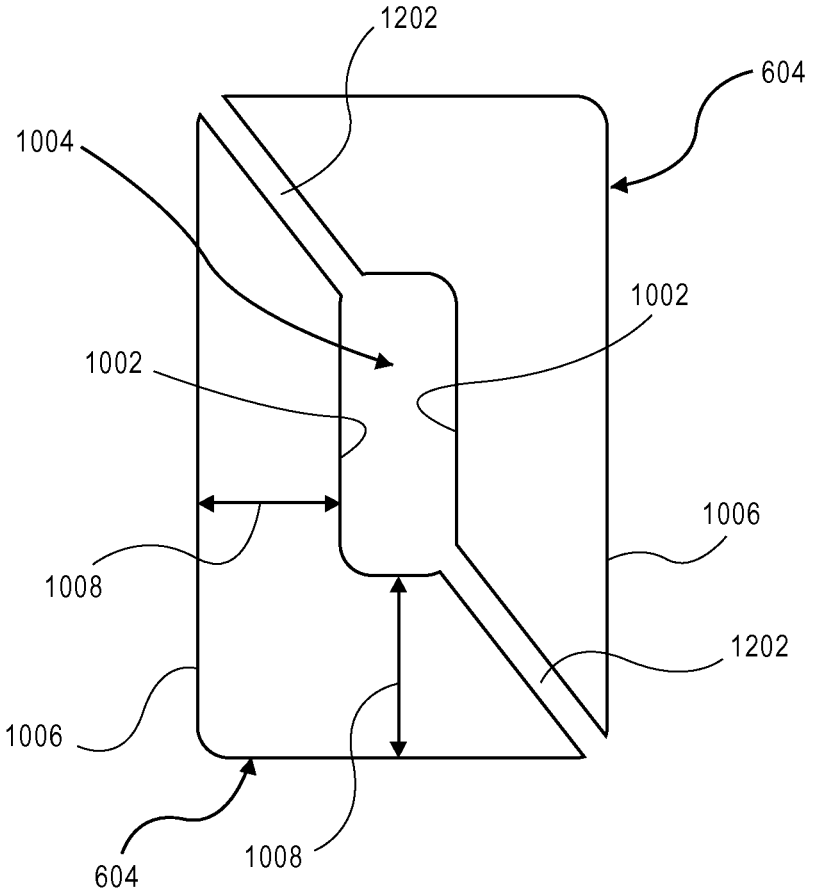
FIG. 12 is a cross-sectional view, taken about line C-C of FIG. 6, of a magnetic insert of an audio speaker in accordance with an embodiment.

Referring to FIG. 12, a cross-sectional view, taken about line C-C of FIG. 6, of a magnetic insert of an audio speaker is shown in accordance with an embodiment. The magnetic system may include at least two magnetic inserts 604 having respective inner edges 1002 or walls radially separated from respective outer edges 1006 or walls by radial width 1008. In an embodiment, the magnetic inserts 604 may each have several linear or arcuate segments. For example, magnetic insert 604 may have a generally "L" shaped structure, i.e., may have two linear segments that intersect at a corner. The magnetic insert segments may have equal or different lengths or widths, e.g., a length or radial width 1008 of one segment may be less than a length or radial width 1008 of another segment, as shown. The segments may be perpendicular to one another as shown, or may be at an obtuse or acute angle. Thus, when a first magnetic insert 604 is paired with a second magnetic insert 604 having similar geometry, the combination of magnetic inserts 604 may form an essentially ring-shaped structure around central opening 1004. The ring-shaped structure may be a rectangular annulus as shown, or may be a quadrilateral annulus with one or two parallel pairs of insert segments as in the case of similar "L" shaped inserts that meet at acute or obtuse angles. In an embodiment, the two magnetic inserts 604 may each follow a semi-circular path to combine to form a circular annulus around central opening 1004. In any case, the two or more magnetic inserts 604 that combine to form an annulus structure around central opening 1004 may be separated from one another by two or more division slots 1202. Accordingly, the annulus formed around central opening 1004 by one or more magnetic inserts 604 may have a discontinuity. Division slots 1202 allow for an essentially ring-shaped structure (albeit discontinuous) to be formed from multiple magnetic inserts 604 such that the individual magnetic inserts 604 may be formed using mass production methods such as die-cutting, without having to waste material that is originally contained within central opening 1004. Reducing material waste can translate to cost reduction when using expensive materials such as high-saturation magnetic materials.

The thickness 808 (into the page) of insert(s) 604 may be equal or different than the depth of corresponding recesses 612 in bottom plate 414. In an embodiment, thickness 808 of magnetic insert 604 is equal to the depth of recess 612 such that an outward facing surface of magnetic insert 604 is coplanar with either support face 610 or rear face 702 (whichever of those faces recess 612 is formed in). Alternatively, thickness 808 of magnetic insert 604 may be greater than the recess 612 depth to increase the likelihood that magnetic insert 604 will fully contact an overlapping portion of a magnet placed over recess 612. Similarly, thickness 808 of magnetic insert 604 may be less than the depth of a corresponding recess 612, as in the case where magnetic insert 604 is loaded into a recess 612 in support face 610 or rear face 702 and does not directly contact lateral magnet 410 or center magnet 406.

Figure 13:
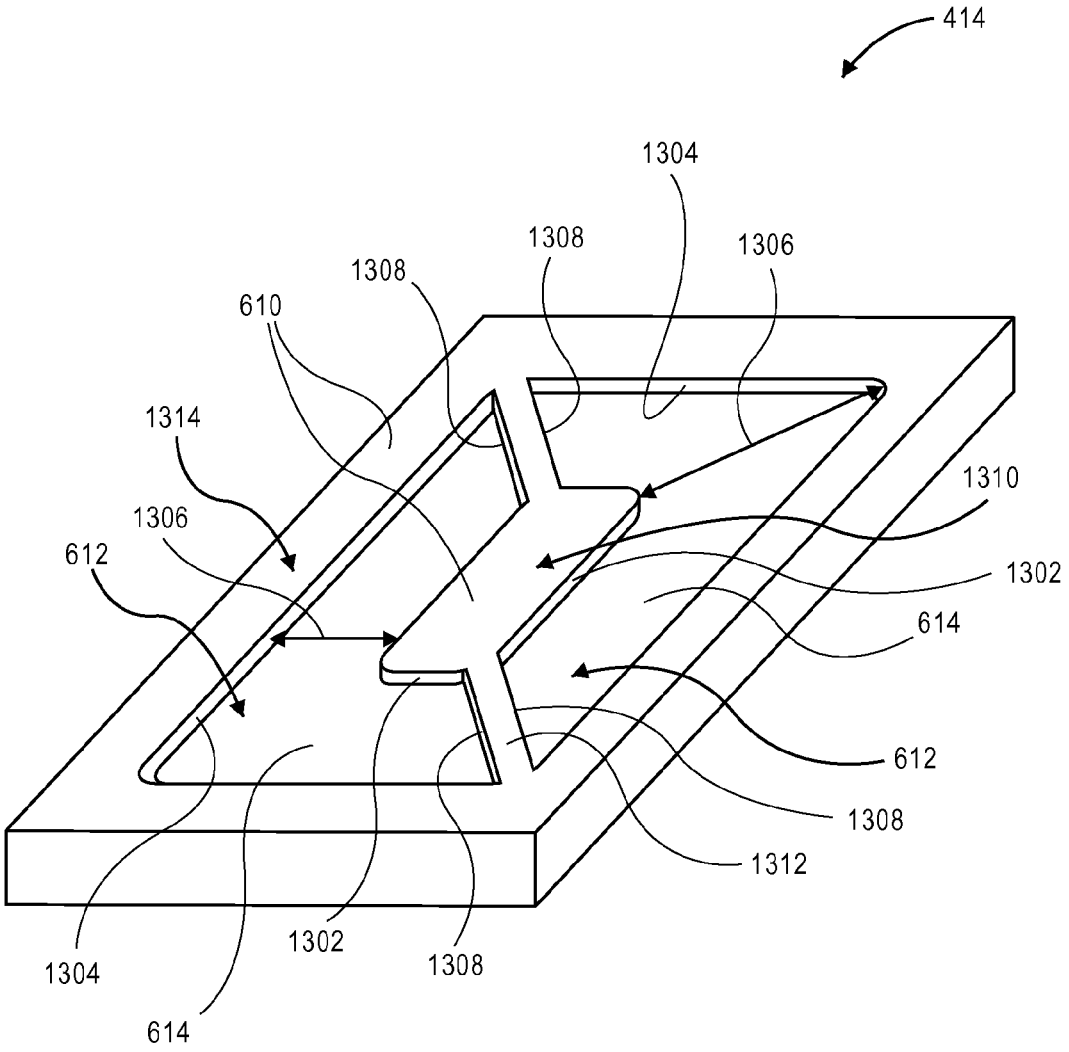
FIG. 13 is a perspective view of a bottom plate of an audio speaker in accordance with an embodiment.

Referring to FIG. 13, a perspective view of a bottom plate of an audio speaker is shown in accordance with an embodiment. Bottom plate 414 may be formed to receive one or more magnetic inserts 604. For example, bottom plate 414 may be formed to receive two "L" shaped magnetic inserts 604 arranged in an essentially ring-shaped structure as shown in FIG. 12. Each recess 612 may be formed in support face 610 of bottom plate 414 (and/or in rear face 702 of bottom plate 414), and thus, may include a recessed face 614 below support face 610. Furthermore, each recess 612 may have a sidewall surrounding recessed face 614. For example, recess 612 may include a recess inner sidewall 1302 separated from a recess outer sidewall 1304 by a radial gap 1306. For example, radial gap 1306 may be at least as wide as the radial width 1008 of magnetic insert 604 to allow magnetic insert 604 to be received within recess 612. Recess 612 may also include recess end sidewalls 1308 on opposite ends of the recess 612 length, e.g., at opposite ends of the "L" shaped recess 612. The distance along recess 612 around a central region 1310 of support face 610 may define a length of recess 612. Furthermore, bottom plate 414 may include a division bridge 1312, i.e., a segment of material extending from central region 1310 to a lateral region 1314 of support face 610, which separates one recess end sidewall 1308 from another. Division bridge 1312 may have a width corresponding to, e.g., equal to or slightly smaller than, division slot 1202 so that magnetic inserts 604 may be received in the recesses 612 of bottom plate 414. Accordingly, bottom plate 414 may be configured to receive an arrangement of magnetic inserts 604 that form a structure around central opening 1004 and at least partly overlap with lateral magnet 410 and center magnet 406 to form a magnetic flux path 504 between those magnets.

Figure 14:
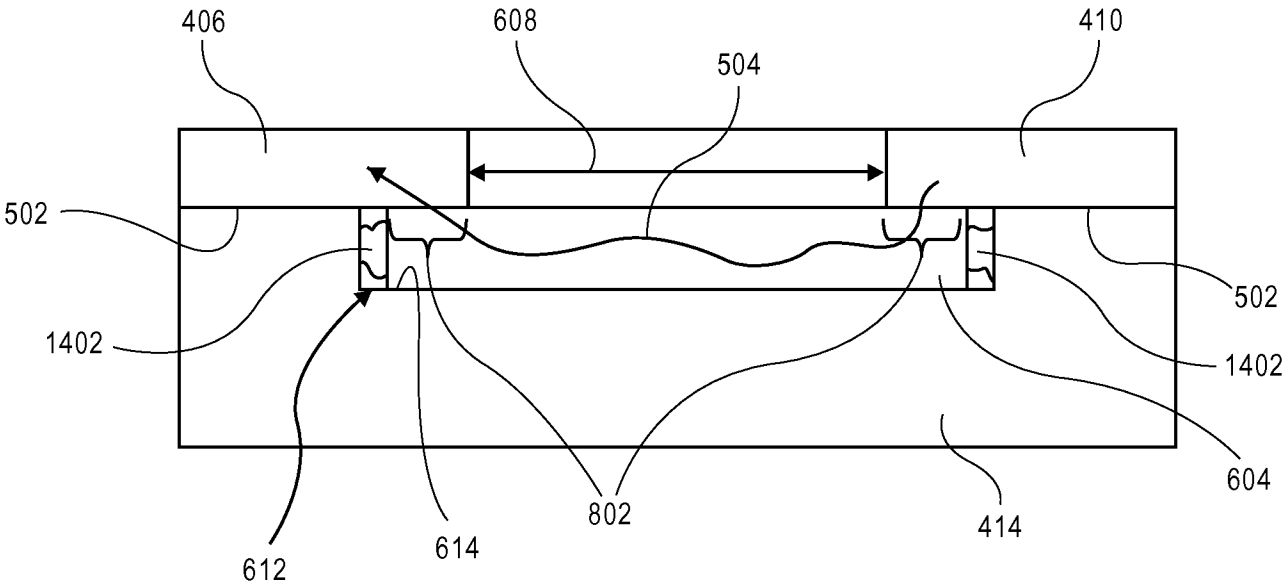
FIG. 14 is a detail view, taken from Detail C of FIG. 6, of a magnetic insert in a recess of an audio speaker in accordance with an embodiment.

Referring to FIG. 14, a detail view, taken from Detail C of FIG. 6, of a magnetic insert in a recess of an audio speaker is shown in accordance with an embodiment. The magnetic system of audio speaker 106 may include center magnet 406 separated from lateral magnet 410 by magnet gap 608. Furthermore, the magnets may be disposed on bottom plate 414 such that respective lower faces 502 of each magnet are in contact with bottom plate 414. In an embodiment, magnetic insert 604 is disposed within recess 612 below the magnets, such that overlapping portion 802 of magnetic insert 604 is in contact with both lower faces 502 of the magnets. Thus, magnetic flux path 504 may be formed between lateral magnet 410 and center magnet 406, and may be preferentially distributed in magnetic insert 604 (rather than in bottom plate 414 around inner surfaces of recess 612) because magnetic insert 604 may be formed from a material with a higher magnetic permeability or a higher magnetic saturation level than bottom plate 414. In an embodiment, magnetic insert 604 may be sandwiched between, and in contact with, the magnets and recessed face 614 on bottom plate 414. Furthermore, the magnetism of magnetic insert 604 may cause it to magnetically snap into place within recess 612 such that there are both magnetic and mechanical forces securing magnetic insert 604 in recess 612. In an alternative embodiment, however, an adhesive 1402 may be placed within a gap between an outer sidewall of magnetic insert 604 and an adjacent sidewall of recess 612, e.g., recess inner sidewall 1302, recess outer sidewall 1304, or recess end sidewall 1308. Thus, adhesive 1402 may bond magnetic insert 604 to bottom plate 414 to fix magnetic insert 604 relative to bottom plate 414.

Figure 15:
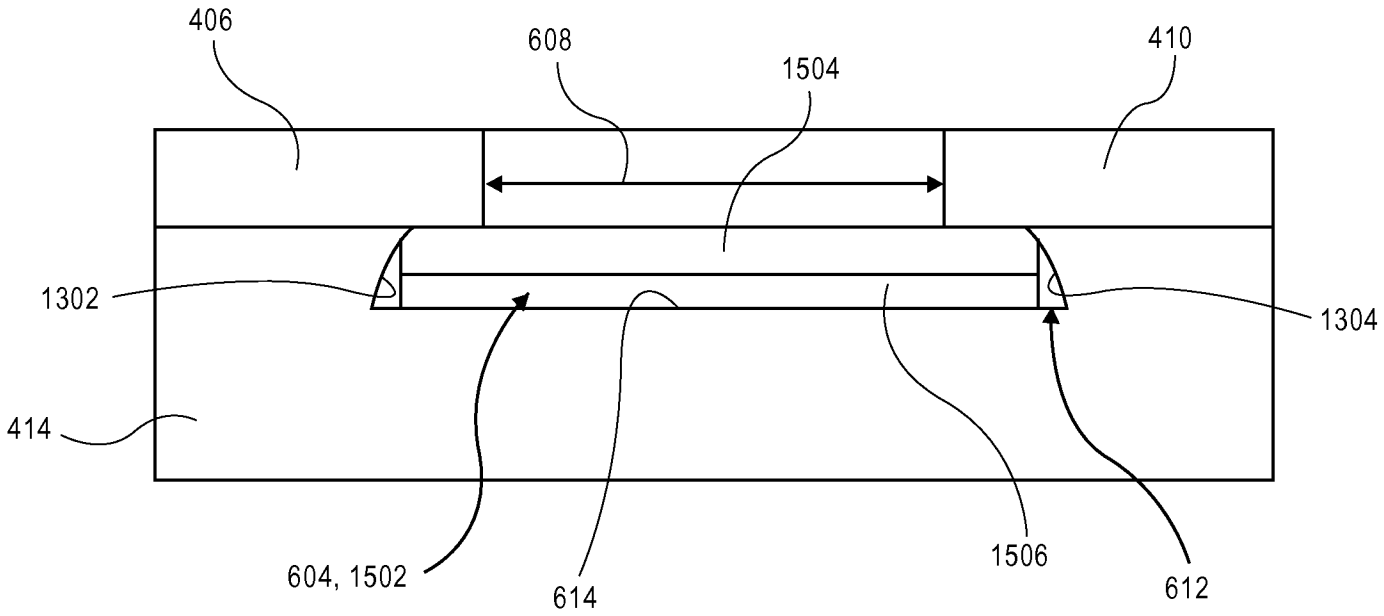
FIG. 15 is a detail view, taken from Detail C of FIG. 6, of a magnetic insert in a recess of an audio speaker in accordance with an embodiment.

Referring to FIG. 15, a detail view, taken from Detail C of FIG. 6, of a magnetic insert in a recess of an audio speaker is shown in accordance with an embodiment. In an embodiment, magnetic insert 604 may be held in place by magnetic forces, adhesive bonding, or mechanical loading from a surrounding structure. For example, insert 604 may be sandwiched between center magnet 406, lateral magnet 410, and bottom plate 414. Additionally, bottom plate 414 may be deformed around magnetic insert 604 to provide an additional retention force. That is, bottom plate 414 may be deformed, e.g., by application of radial loading around the outer perimeter of bottom plate 414, to cause recess inner sidewall 1302 and recess outer sidewall 1304 to bend inward and form tabs that pinch an outer sidewall of magnetic insert 604. This pinching can press magnetic insert 604 against bottom plate 414 and prevent magnetic insert 604 from being removed from recess 612.

Still referring to FIG. 15, magnetic insert 604 may include a laminate structure 1502. For example, magnetic insert 604 may be multi-layered, e.g., may have a top layer 1504 and a bottom layer 1506. Bottom layer 1506 may be disposed on recessed face 614 within recess 612, and top layer 1504 may be disposed above and/or on bottom layer 1506 such that an outward facing surface of top layer 1504 is directed toward magnet gap 608. More particularly, the outward facing surface of top layer 1504 may be in contact with lateral magnet 410 and/or center magnet 406 across overlapping portion 802 of magnetic insert 604. Thus, laminate structure 1502 provides a magnetic insert 604 that fills recess 612 by combining several layers. Each layer may be formed from a high-saturation magnetic material cut from a material sheet. Thus, lamination of the layers allows for a magnetic insert 604 of a given overall thickness to be fabricated even when cutting of a thick sheet of the higher-saturation magnetic material having the given thickness is impractical.

Figure 16:
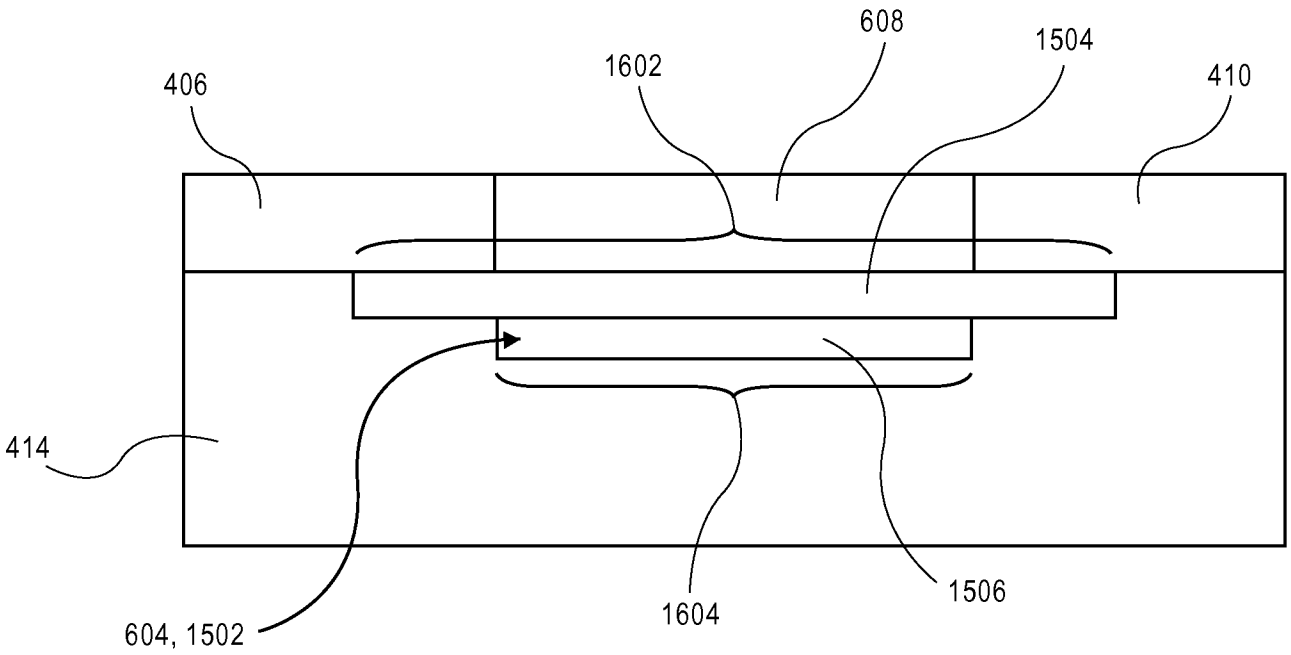
FIG. 16 is a detail view, taken from Detail C of FIG. 6, of a magnetic insert in a recess of an audio speaker in accordance with an embodiment.

Referring to FIG. 16, a detail view, taken from Detail C of FIG. 6, of a magnetic insert in a recess of an audio speaker is shown in accordance with an embodiment. In addition to allowing for a given thickness 808 of magnetic insert 604 to be achieved, laminate structure 1502 may provide for a magnetic insert 604 to be fabricated having a complex cross-sectional profile. Magnetic insert 604 may include laminate structure 1502 having top layer 1504 and bottom layer 1506 in recess 612 of bottom plate 414. Top layer 1504 and bottom layer 1506 may, however, have different widths. For example, top layer 1504 may include a top width 1602 that is greater than a bottom width 1604 of bottom layer 1506. As such, laminate structure 1502 may have a stepped profile. The stepped profile may provide for an overlapping portion 802 of top layer 1504 to be under and in contact with lateral magnet 410 and/or center magnet 406. Bottom layer 1506, however, may not be under lateral magnet 410 or center magnet 406 in the case where bottom width 1604 is narrower than a distance of magnet gap 608. Thus, magnetic insert 604 may have a cross-sectional profile that is contoured to meet certain design goals.

Other types of contours may be achieved by forming magnetic insert 604 with laminate structure 1502. For example, magnetic insert 604 may have a tapered cross-sectional profile. In an embodiment, several layers of magnetic insert 604 material may be laminated together and each layer may have a progressively narrower width. The layers may be centered over each other such that the edge of the laminate structure 1502 tapers inward progressively from each layer to the next (as shown in the two-layered embodiment of FIG. 16). Subsequent machining operations, such as grinding of the edges, may be used to modify the edge shape from a stepwise taper to a smooth taper. Accordingly, magnetic insert 604 having laminate structure 1502 can be formed to include a desired thickness and/or contoured cross-sectional profile.

High-saturation magnetic materials can be difficult to shape by machining processes, and thus, laminate structure 1502 provides a practical and feasible solution to produce a contoured magnetic insert 604 formed from high-saturation magnetic material. The contoured profile may provide increased contact area between overlapping portion 802 of magnetic insert 604 and a respective magnet, and also includes a varying overall thickness 808 to reduce the likelihood of saturation of magnetic insert 604 between lateral magnet 410 and center magnet 406. By reducing the likelihood of magnetic saturation of the entire cross-section of magnetic insert 604, magnetic insert 604 constrains magnetic flux rather than leaking stray flux into the adjacent bottom plate 414, magnet gap 608, or surrounding environment. Furthermore, since the contoured surface can locate high-saturation magnetic material only where it is required to increase the magnetic saturation level, unnecessary use of high-saturation magnetic material may be limited, and thus, material costs may be reduced.

Figure 17:
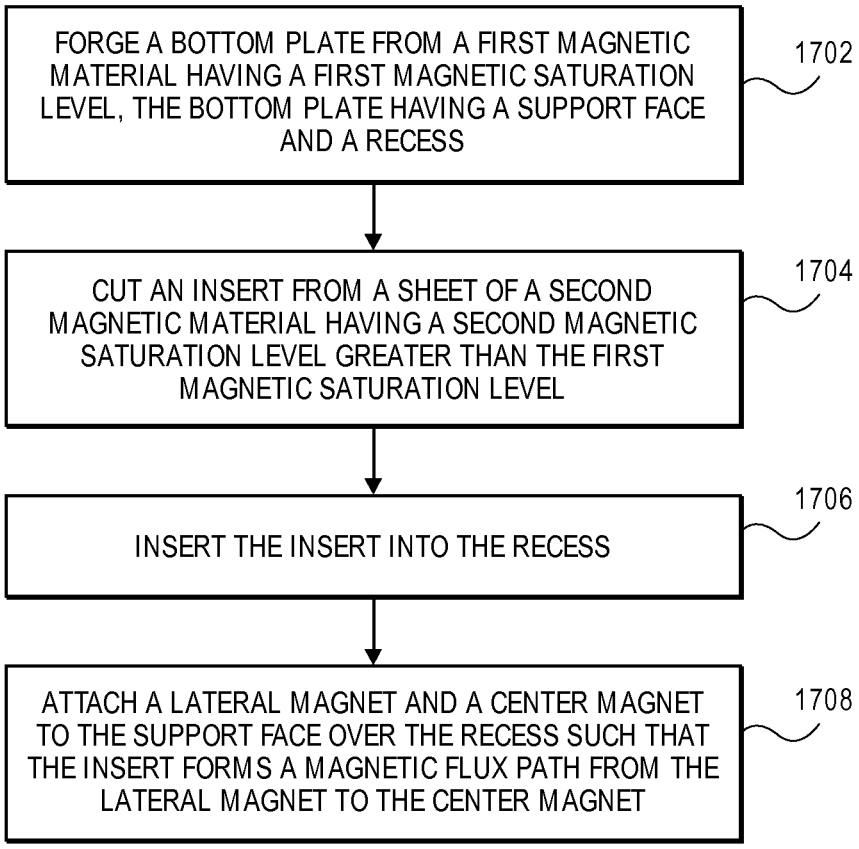
FIG. 17 is a flowchart of a method of manufacturing an audio speaker having a high-saturation magnetic insert in a recess of a bottom plate in accordance with an embodiment.

Referring to FIG. 17, a flowchart of a method of manufacturing an audio speaker having a high-saturation magnetic insert in a recess of a bottom plate is shown in accordance with an embodiment. At operation 1702, bottom plate 414 may be formed from a magnetic material having a magnetic saturation level. For example, bottom plate 414 may be forged from a magnetic material, such as magnetic steel. Bottom plate 414 may be forged in a variety of shapes, and in an embodiment, bottom plate 414 includes a thickness in an axial direction of between 0.2-5 mm, e.g., between 0.3 to 1 mm. In an embodiment, the forging process used to form bottom plate 414 may include pressing or stamping recess 612 into bottom plate 414. Thus, bottom plate 414 may be formed with recessed face 614 and support face 610, facing a same or different direction. Although recess 612 may be formed in bottom plate 414 during a forging process, alternatively, bottom plate 414 may instead be formed using other processes, such as casting or stamping alone. For example, bottom plate 414 may be cast, stamped, or forged and then recess 612 may be formed in bottom plate 414 using subsequent operations. For example, recess 612 may be formed in bottom plate 414 using machining operations, e.g., by milling recess 612 into support face 610 and/or rear face 702. Alternatively, recess 612 may be etched into bottom plate 414 in a subsequent operation.

At operation 1704, magnetic insert 604 may be formed from a sheet of material having a higher magnetic saturation level than the material used to form bottom plate 414. For example, magnetic insert 604 may be cut from a sheet of high-saturation magnetic material, e.g., Hiperco® 27. More particularly, magnetic insert 604 may be formed from a material that has a magnetic saturation level higher than that of the material used to form bottom plate 414. In an embodiment, magnetic insert 604 may be die-cut from the sheet of magnetic material. Die-cutting is a low-cost method suitable to mass production, and thus, by die-cutting magnetic insert 604 from a sheet of material, e.g., a rolled sheet of material, the magnetic system of audio speaker 106 can be feasibly produced. Die-cutting of a high-saturation magnetic material can be achieved using material sheet thicknesses of up to 0.050 inch. Thus, magnetic insert 604 may be formed in a single layer having a die-cut thickness 808 up to 0.050 inch. Alternatively, multiple layers of die-cut material (or thicker layers using other cutting processes such as laser cutting) may be laminated to build laminate structure 1502, and thus, magnetic insert 604 may have a total thickness 808 greater than 0.050 inch. Accordingly, the method of manufacturing audio speaker 106 may include laminating, e.g., bonding or otherwise attaching, multiple die-cut magnetic insert 604 layers together to form a composite magnetic insert 604 structure, i.e., laminate structure 1502, having a desired thickness and shape.

At operation 1706, magnetic insert 604 may be inserted into recess 612. More particularly, magnetic insert 604 may be disposed in recess 612 and maintained in place by a magnetic attraction between magnetic insert 604 and bottom plate 414. Optionally, low viscosity adhesive 1402 may be flowed into a gap between magnetic insert 604 and sidewalls of recess 612 to further retain magnetic insert 604. In an embodiment, the adhesive 1402 is not applied between magnetic insert 604 and recessed face 614 to avoid increasing the vertical thickness 808, i.e., the z-height, of audio speaker 106 any more than is necessary. As an alternative to, or in addition to, adhesive 1402, bottom plate 414 may be deformed to pinch magnetic insert 604 along an edge and/or press and retain magnetic insert 604 against recessed face 614.

At operation 1708, lateral magnet 410 and center magnet 406 may be attached to support face 610 of bottom plate 414. More particularly, one or both of the magnets may be bonded to bottom plate 414 or housing 302 using adhesives in locations that do not impede the magnetic field of the magnetic system. The lateral magnet 410 and/or center magnet 406 may be disposed over recess 612 such that magnetic insert 604 is under one or both magnets. For example, magnetic insert 604 may include overlapping portions 802 that are under and in contact with lateral magnet 410 and/or center magnet 406. Accordingly, magnetic flux path 504 may be directed from lateral magnet 410 to center magnet 406 through the high-saturation magnetic insert 604. Other components of audio speaker 106, such as top plate 412 and the moving assembly, and housing 302 may be assembled to form audio speaker 106 having a desired form factor. Audio speaker 106 may then be integrated with other components to fabricate electronic device 100.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An audio speaker, comprising:

a bottom plate having a support face and a recess, wherein the recess includes a recessed face below the support face, and wherein the bottom plate includes a first magnetic material having a first magnetic saturation level;

a center magnet on the support face and over the recess;

a lateral magnet on the support face and over the recess, the lateral magnet radially separated from the center magnet by a magnet gap;

a voicecoil for driving a diaphragm, the voicecoil aligned with the magnet gap; and a magnetic insert in the recess on the recessed face, the magnetic insert below the lateral magnet and the center magnet to form a magnetic flux path from the lateral magnet to the center magnet, wherein the magnetic insert includes a second magnetic material having a second magnetic saturation level greater than the first magnetic saturation level.

2. The audio speaker of claim 1, wherein the magnetic insert includes an upper face overlapping respective lower faces of the lateral magnet and the center magnet to form the magnetic flux path from the lateral magnet into a first overlapping portion of the upper face and from a second overlapping portion of the upper face to the center magnet.

3. The audio speaker of claim 2, wherein the first overlapping portion of the magnetic insert is in contact with the lateral magnet.

4. The audio speaker of claim 3, wherein the recess is in the support face such that the support face and the recessed face both face a forward direction.

5. The audio speaker of claim 3, wherein the recess is in a rear face of the bottom plate opposite from the support face such that the support face faces a forward direction and the recessed face faces a rearward direction.

6. The audio speaker of claim 2, wherein the upper face includes a radial width between an outer edge under the lateral magnet and an inner edge, and wherein the radial width is wider than the magnet gap between the lateral magnet and the center magnet.

7. The audio speaker of claim 6, wherein the magnetic insert includes a thickness less than 1.5 mm.

8. The audio speaker of claim 7, wherein the upper face is ring-shaped such that the inner edge defines a central opening under the center magnet.

9. The audio speaker of claim 2, wherein the magnetic insert includes a laminate structure having a first layer and a second layer, and wherein the first layer is on the recessed face and the second layer is on the first layer.

10. The audio speaker of claim 9, wherein the first layer includes a first width, and wherein the second layer includes a second width different than the first width.

11. The audio speaker of claim 2, wherein the first magnetic material includes a magnetic steel material, and wherein the second magnetic material includes a high-saturation magnetic material.

12. The audio speaker of claim 11, wherein the second magnetic saturation level is at least 10% greater than the first magnetic saturation level.

13. The audio speaker of claim 12, wherein the high-saturation magnetic material is an iron-cobalt alloy.

14. An audio speaker, comprising:

a voicecoil for driving a diaphragm along a central axis, the voicecoil disposed in a magnetic gap of a top plate;

a bottom plate having a support face and a plurality of recesses, each recess providing a radial gap between a central region of the support face and a lateral region of the support face, wherein the bottom plate includes a first magnetic material having a first magnetic saturation level;

a center magnet disposed between the top plate and the bottom plate on the central region;

a plurality of lateral magnets disposed between the top plate and the bottom plate on the lateral region, the lateral magnets disposed around the center magnet; and a plurality of magnetic inserts in respective recesses of the plurality of recesses, each magnetic insert forming a magnetic flux path from a respective lateral magnet to the center magnet through a respective radial gap, wherein the magnetic insert includes a second magnetic material having a second magnetic saturation level greater than the first magnetic saturation level.

15. The audio speaker of claim 14, wherein the lateral magnets are symmetrically disposed around the center magnet.

16. The audio speaker of claim 15, wherein the plurality of recesses include one or more recessed faces facing a same direction as the support face.

17. The audio speaker of claim 15, wherein the plurality of recesses include one or more recessed faces facing an opposite direction as the support face.

* * * * *